US007100793B2

(12) United States Patent
Baum

(10) Patent No.: US 7,100,793 B2
(45) Date of Patent: Sep. 5, 2006

(54) PILL DISPENSER

(76) Inventor: Elliot Baum, 28 Randolph Ave., Dix Hills, NY (US) 11779

( * ) Notice: Subject to any disclaimer, the term of this patent is extended or adjusted under 35 U.S.C. 154(b) by 333 days.

(21) Appl. No.: 10/752,900

(22) Filed: Jan. 6, 2004

(65) Prior Publication Data

US 2004/0182873 A1 Sep. 23, 2004

Related U.S. Application Data

(60) Provisional application No. 60/438,241, filed on Jan. 6, 2003.

(51) Int. Cl.
*B65B 59/00* (2006.01)
*G07F 11/16* (2006.01)

(52) U.S. Cl. ..... 221/15; 221/277; 221/247

(58) Field of Classification Search ..... 221/15, 221/188, 247, 277
See application file for complete search history.

(56) References Cited

U.S. PATENT DOCUMENTS

| | | | | |
|---|---|---|---|---|
| D195,734 | S | 7/1963 | Beaumann | |
| 3,722,739 | A * | 3/1973 | Blumberg | 221/3 |
| 3,921,806 | A * | 11/1975 | Wawracz | 206/534 |
| 3,926,335 | A * | 12/1975 | Dangles et al. | 221/82 |
| 4,124,143 | A | 11/1978 | Thomas | |
| 4,572,376 | A * | 2/1986 | Wrennall | 206/538 |
| 5,664,697 | A | 9/1997 | Lambelet, Jr. et al. | |
| D387,552 | S | 12/1997 | Hayman | |
| 6,098,835 | A | 8/2000 | DeJonge | |
| 6,193,103 | B1 | 2/2001 | Clarijs | |
| 6,234,343 | B1 | 5/2001 | Papp | |
| D451,666 | S | 12/2001 | Zastrow | |
| 6,364,155 | B1 | 4/2002 | Wolfe | |
| D460,897 | S | 7/2002 | Leuenberger | |
| D473,786 | S | 4/2003 | Chue | |
| D485,979 | S | 2/2004 | Chue | |
| D502,801 | S | 3/2005 | Baum | |
| 2002/0047019 | A1 | 4/2002 | Devers | |

OTHER PUBLICATIONS

"The Sharper Image Automatic Vitamin & Pill Organizer" Model SI692, 2001.
Introducing "Companion" Emergency Response Medical Systems, pp. 14 and 15, Jul. 2, 2002.

* cited by examiner

*Primary Examiner*—Gene O. Crawford
*Assistant Examiner*—Timothy Waggoner
(74) *Attorney, Agent, or Firm*—Frishauf, Holtz, Goodman & Chick, P.C.

(57) ABSTRACT

Pill dispenser including a base with multiple compartments receivable of pills and a cover member engaging with the base and rotatable relative thereto. The cover member includes an access opening selectively alignable with each compartment upon rotation of the cover member relative to the base to enable removal of pills in each compartment when in alignment with the access opening. The base includes indicia for the timed dosage of pills arranged in alignment with the compartments. A retaining member is removably arranged in the base and receives a pill holder with an optional clock/alarm/timer unit. The pill holder includes a pill-receiving compartment which can store light-sensitive pills or an emergency supply of pills or money. The clock/alarm/timer unit includes a pill timer setting which activates an alarm at a set time. The alarm remains activated up to 25 hours if pills are not removed from one of the compartments.

29 Claims, 15 Drawing Sheets

FIG. 1
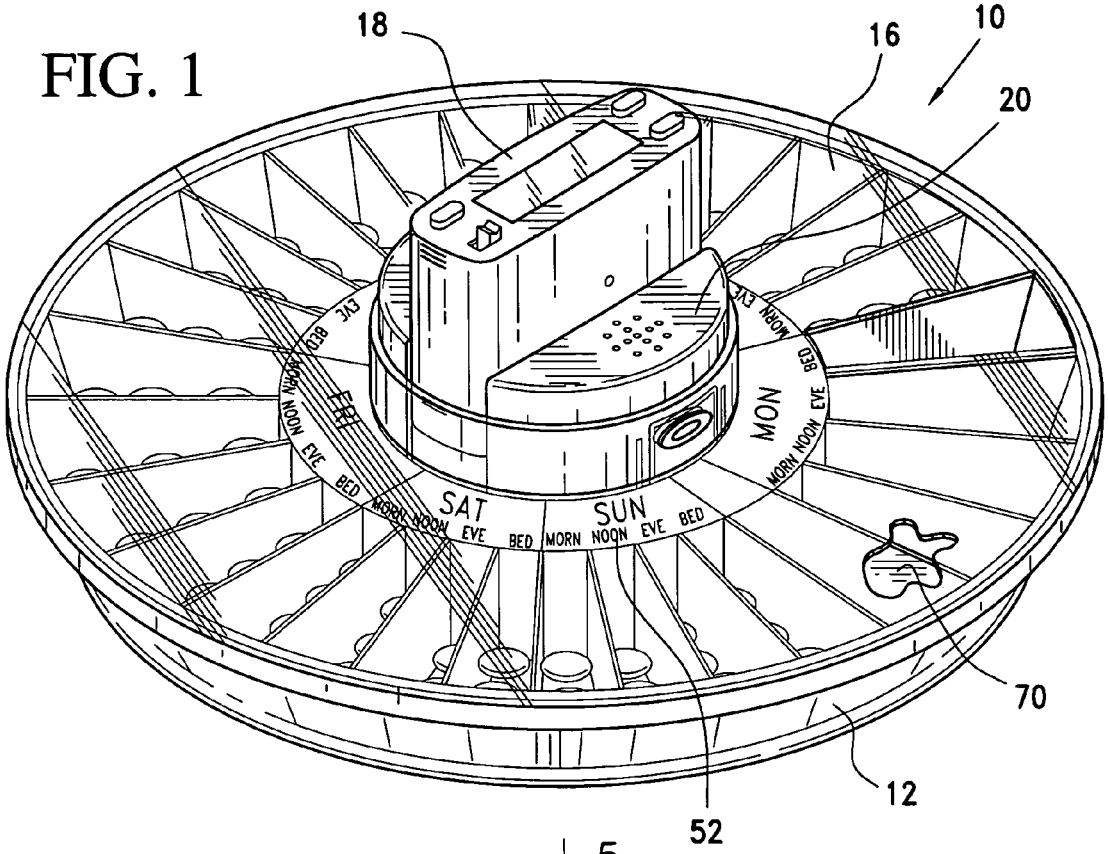
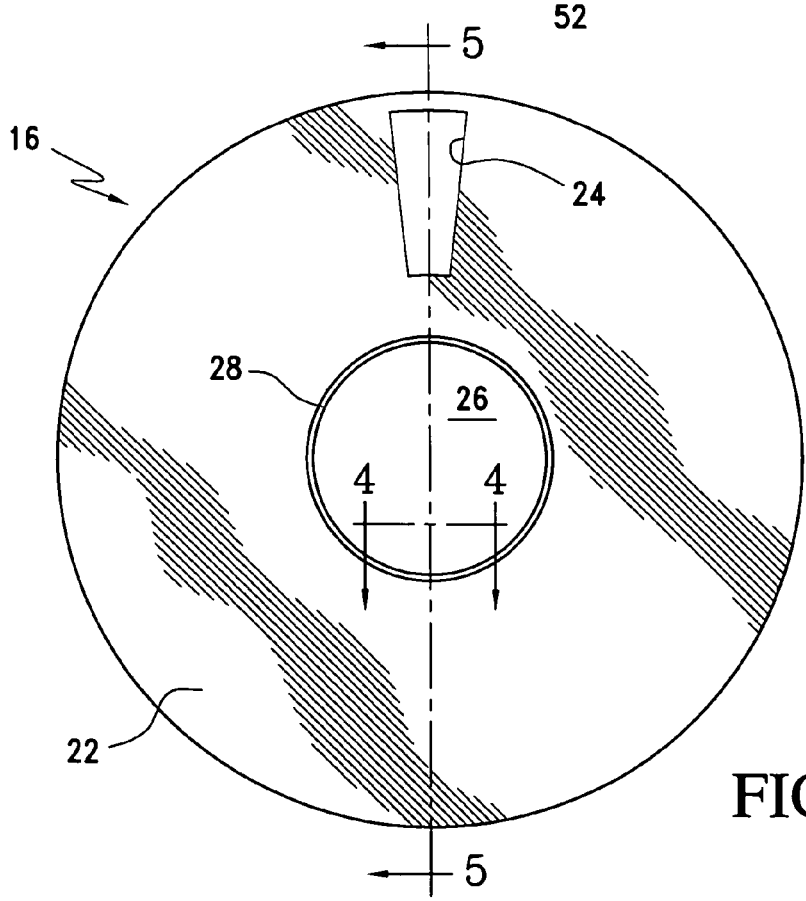
FIG. 2

PILL DISPENSER

CROSS-REFERENCE TO RELATED APPLICATION

This application claims the benefit of priority of U.S. provisional patent application Ser. No. 60/438,241 filed Jan. 6, 2003.

FIELD OF THE INVENTION

The present invention relates generally to a dispenser for pills and more particularly to a dispenser which enables multiple dosages of pills, taken over a period of time, to be stored individually in the dispenser and individually dispensed from the dispenser. The dispenser also allows the user to see what medications/pills are due to be taken and what medications/pills were missed (i.e., not timely taken).

The present invention also relates to a pill dispenser which provides an alarm to notify the user to take medication at a specific time.

BACKGROUND OF THE INVENTION

In view of the growth in treatable medical illnesses and conditions, numerous individuals are required to take one or more pills on a regular basis, such as daily, or once every four to six hours. To this end, there are a variety of pill dispensers which enable multiple dosages of the pills to be placed into the dispenser such that by manipulating the dispenser, each dose is individually dispensed. The dispenser is manipulated each time a dosage consisting of one or more pills is required to be taken, e.g., once every four to six hours, once every day.

The dispensing of pills from prior art dispensers is not always easy and in fact is often difficult. In addition, often the dosages for each medicine are pre-packaged in blister packs and the like so that it is not possible to combine different medications in a single dosage. Thus, when it is required to obtain each dosage, several pill dispensers might have to be manipulated to obtain all the necessary medication.

As used herein, pills are deemed to comprise any type of medication including but not limited to capsules, tablets and other pharmaceutical drugs sold in solid-state form or enclosed in a sold form.

OBJECTS AND SUMMARY OF THE INVENTION

It is an object of the present invention to provide a new pill dispenser which provides easy dispensing of one or more pills in individual dosages each of which is stored in a separate compartment.

Still another object of the present invention is to provide a new pill dispenser which incorporates a clock to enable the user to readily see whether it is the appropriate time to take a dosage of pills and/or alarm to notify the user that it is the time to take a dosage of pills.

It is another object of the present invention to provide a new pill dispenser which contains adjustable dosage compartments.

It is yet another object of the present invention to provide a new refillable pill dispenser capable of holding several days worth of pills, a week's worth of pills or up to 28 days worth of pills, each dosage in a separate compartment, and a dosage guide which provides guidance as to when the pills should be taken.

It is still another object of the present invention to provide a new pill dispenser which is portable and refillable.

It is yet another object of the present invention to provide a new pill dispenser which can be mounted either to a horizontal surface or to a vertical surface.

In order to achieve these objects and others, a pill dispenser in accordance with the invention includes a base including a plurality of compartments receivable of pills and a cover member releasably engaging with the base and rotatable relative thereto when in engagement therewith. The cover member includes an access opening selectively alignable with each compartment upon rotation of the cover member relative to the base to enable removal of pills in each compartment when in alignment with the access opening. The base preferably includes indicia for the timed dosage of pills received in the compartments arranged in alignment with the compartments. A retaining member is removably arranged in a cavity defined in the base and receives a pill holder which is optionally integrated in combination with an clock/alarm/timer unit. Thus, the pill holder is usable as either a basic travel pill holder for holding pills or when including the clock/alarm/timer unit, it provides the benefits of providing the time, enabling an alarm to be set and activated and enabling a timer to be set and activated. In both configurations, the pill holder includes an accessible pill-receiving compartment which enables light-sensitive pills or an emergency supply of pills to be stored therein.

The base, cover member, retaining member and pill holder with optional clock/alarm/timer unit include various structures which enable the components to be removably coupled to one another. This is needed in order to allow pills to be inserted into the compartments in the base as well as to the clean the dispenser. For example, the cover member and retaining member are coupled to one another by flexible tabs formed in the retaining member which enter into apertures in the cover member. The retaining member and pill with the optional clock/alarm/timer unit include cooperating recesses and projections.

Another embodiment of a pill dispenser in accordance with the invention comprises a base having an interior space and including at least one wall having a slot, a dispenser mechanism arranged in the interior space to partition the interior space into a plurality of pill-receiving compartments and a dispensing tray. having a pill-receiving cavity. The dispenser mechanism is movable to separately cause each compartment to align with the slot and the dispensing tray removably engages with the base and has a position in which the cavity aligns with the slot. In use, any pills in a compartment aligning with the slot fall from the compartment into the cavity through the slot when the dispensing tray is in the position in which the cavity aligns with the slot and are retrievable from the cavity upon removal of the dispensing tray from engagement with the base.

A detent mechanism is provided for positioning the dispenser mechanism only in predetermined positions relative to the base. The detent mechanism may comprise a projection arranged on the base and corresponding notches formed on the dispenser mechanism. Each notch is arranged relative to a respective compartment such that when the projection extends into the notch, the respective compartment aligns with the slot. In one embodiment, the dispenser mechanism comprises a dispenser wheel having interconnected radial fins extending from a cylindrical wall on which the notches are formed.

A cover member may be arranged alongside the dispenser mechanism for closing the interior space and thus the compartments. The cover member may be secured against the dispenser mechanism by tabs formed on the base.

Guide mechanisms are provided for guiding the movement of the dispensing tray. The guide mechanisms may include rails formed on a outer surface of the wall of the base, one on each side of the slot.

When a slot is formed in each of two walls of the base, two dispensing trays may be provided, each arranged to engage with the base in a different manner and to receive pills falling from a compartment in the pill-dispensing position through a respective slot. By positioning the slots in walls perpendicular to one another, the dispenser can be operable in both a vertical orientation and a horizontal orientation. Plates are provided to close each slot when the other slot is being used.

Another embodiment of a pill dispenser in accordance with the invention comprises a base including a plurality of compartments receivable of pills and a cover member releasably engaging with and rotatable relative to the base when in engagement with the base. The cover member includes an opening selectively alignable with each compartment upon rotation of the cover member relative to the base to enable removal of pills in each compartments when in alignment with the opening.

In one form of this pill dispenser, the base includes a substantially circular bottom wall, a cylindrical outer wall extending from a peripheral edge of the bottom wall, a cylindrical inner wall spaced from the outer wall and fins partitioning the space between the outer and inner walls into compartments. The base may also include a covering wall formed opposite the bottom wall over one of the compartments to enable the dispenser to assume a shipping and storage position in which all of the compartments are closed. The base may also include a circular upper wall extending inward from an upper peripheral edge of the inner wall so that a dosage guide may be arranged on the circular upper wall. The dosage guide may include indicia for timed dosage of the pills from the compartments. The cover member may be substantially circular and have a rim overlying an upper peripheral edge of the base to frictionally engage the base.

In another form, the base includes a substantially circular wall, an outer wall extending from a peripheral edge of the circular wall, a cylindrical inner wall spaced from the outer wall and dividers spaced circumferentially around the base to divide a space between the outer and inner walls into compartments. The dividers may be variably spaced around the circumference of the base to provide compartments having different sizes. The base may also include an upper wall formed inward of the inner wall and including an annular portion defining a central opening and a covering portion situated opposite the circular wall over one compartment to close that compartment. The upper wall includes indicia for the timed dosage of pills received in the compartments.

Another embodiment of a pill dispenser in accordance with the invention comprises a base and a housing rotatably mounted on the base and having a prismatic shape with each side of the prism defining a row of pill-receiving compartments. A cover member covers each row of compartments and slides in slots defined by shoulders of axial walls of the housing to thereby selectively cover and expose the compartments in that row. Upon rotation of the housing relative to the base, one of the rows of compartments is brought into a pill-dispensing position, which is ensured by a detent mechanism, so that by sliding the cover member over that row outward, the compartments in that row can be exposed sequentially thereby allowing the pills in each compartment to be released from the compartment and fall into a dispensing tray in the base.

The detent mechanism thus fixes the housing only in pre-determined positions relative to the base such that each row of compartments is fixed only in pre-determined positions relative to the dispensing tray.

Instead of a base having a dispensing tray which is designed for placement on a horizontal surface, it is also possible to use a wall mounting bracket to mount the housing to a vertical surface. In this case, the bracket includes apertures to facilitate the connection to the vertical surface, e.g., using screws, nails and the like. Since a dispensing tray is not present, the pill-dispensing position is selected so that the pills are released from the compartments in the row in the pill-dispensing position by gravity and thus must be caught manually.

BRIEF DESCRIPTION OF THE DRAWINGS

The invention, together with further objects and advantages thereof, may best be understood by reference to the following description taken in conjunction with the accompanying drawings, wherein like reference numerals identify like elements, and wherein:

FIG. 1 is a perspective view of a first embodiment of a pill dispenser in accordance with the invention.

FIG. 2 is a top view of a cover member of the pill dispenser shown in FIG. 1.

DETAILED DESCRIPTION OF THE PREFERRED EMBODIMENTS

Figure 3:
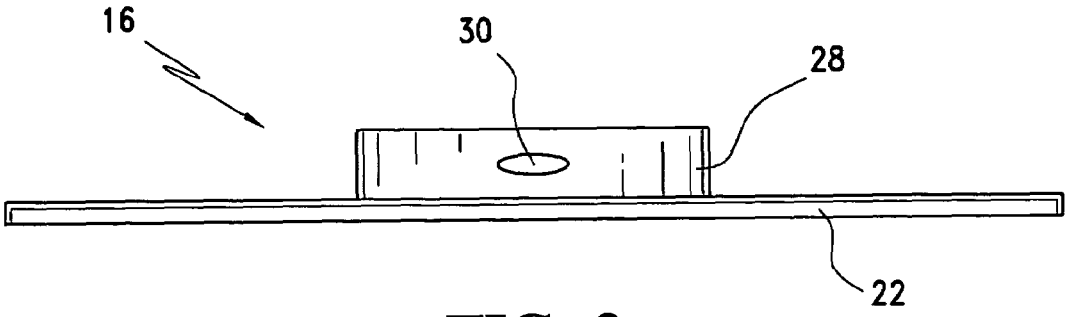
FIG. 3 is a side view of the cover member shown in FIG. 2.
Figure 4:
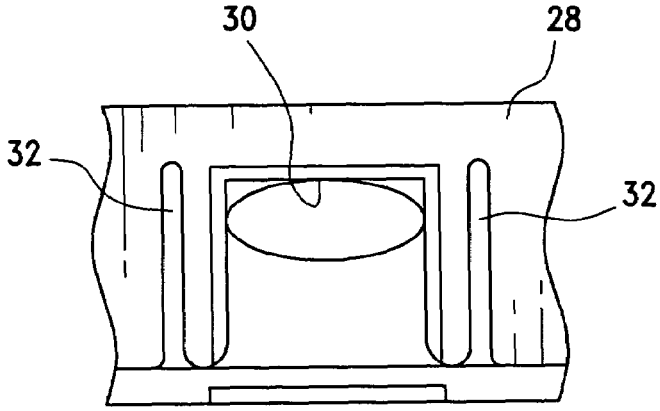
FIG. 4 is a view taken along line 4—4 of FIG. 2.
Figure 5:
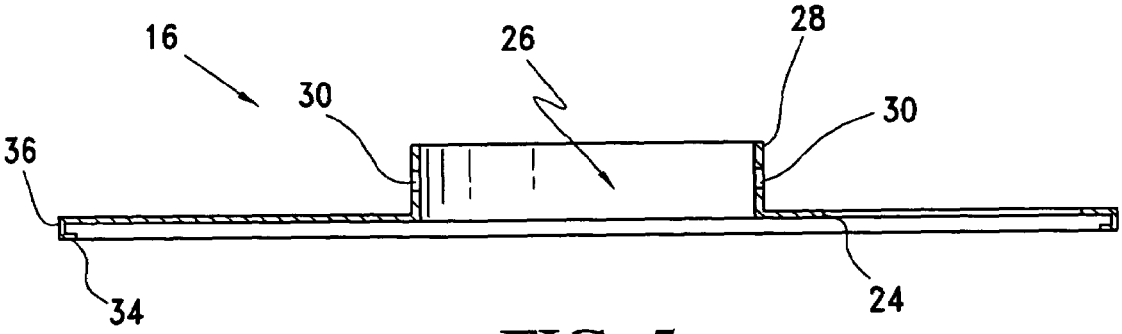
FIG. 5 is a cross sectional view of the cover member shown in FIG. 2 taken along the line 5—5.

Referring initially to FIGS. 1–12, a first embodiment of a pill dispenser in accordance with the invention is designated generally as 10 and comprises a base 12 including a plurality of compartments 14 receivable of pills, a substantially circular cover member 16 releasably engageable with the base 12 and rotatable relative thereto, a pill holder including a clock/alarm/timer unit 18 and a retaining member 20 which is removably arranged in connection with the base 12 and releasably retains the pill holder 18.

As shown in FIGS. 2–5, the cover member 16 includes an annular, substantially planar portion 22 defining a compartment access opening 24 which is selectively alignable with each of the compartments 14 to enable the removal of any pills in that compartment 14. Access opening 24 has a size substantially the same as or smaller than the cross-sectional size of a smallest one of the compartments 14 to avoid a undesired situation where the access opening 24 exposes more than one compartment 14.

A circular opening 26 is formed in the center of the annular portion 22 and a circular rim 28 extends upward from an inner edge of the annular portion 22 around the circular opening 26. An engagement mechanism is formed on the rim 28 for enabling the cover member 16 to releasably mate with the retaining member 20. Specifically, apertures 30 are formed on opposite sides of the rim 28 and axially extending channels 32 are formed on an inner surface of the rim 28 on the sides of the apertures 30 (see FIG. 3). The cooperating structure on the retaining member 20 is described below.

An engagement mechanism is also formed on the cover member 16 to enable the cover member 16 to releasably mate with the base 12. Specifically, this engagement mechanism includes a flange 34 projecting inward from an edge of a circular rim 36 which extends downward from the outer peripheral edge of the annular portion 22 (see FIG. 5). Instead of a single flange 34, a plurality of flanges having different sizes can be provided. The cooperating structure on the base 12 is described below.

Cover member 16 may be formed from a rigid, transparent material, such as a transparent plastic, to enable viewing of the contents of the compartments 14 without removing the cover member 16 from engagement with the base 12. This allows the number and type of pills in the compartments 14 to be viewed without removing the cover member 16 from engagement with the base 12. By viewing which of the compartments 14 include pills, it becomes possible to determine whether a dose has been missed (in conjunction with the indicia on the base 12 which indicates when the dosage was to be taken-discussed below).

Figure 6:
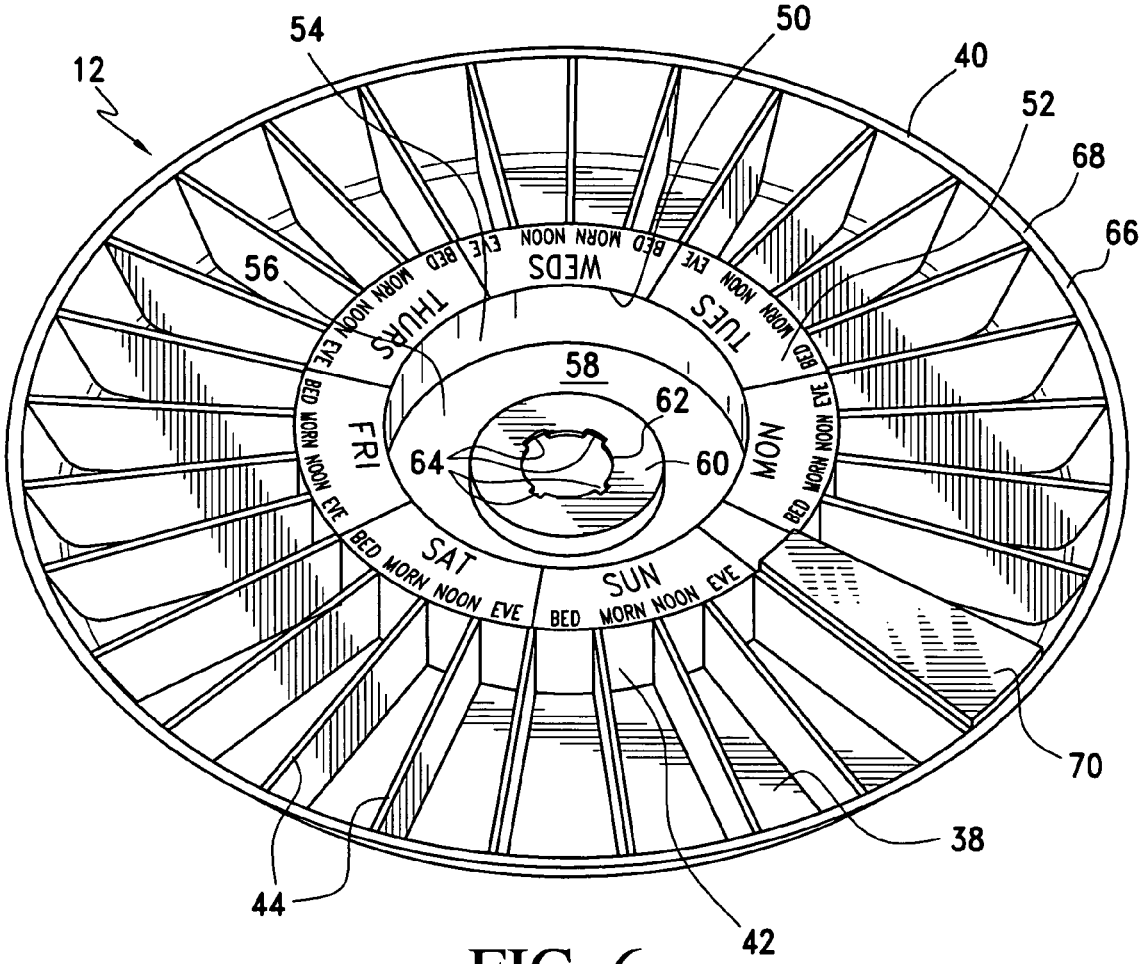
FIG. 6 is a top, perspective view of a base of the pill dispenser shown in FIG. 1.
Figure 7:
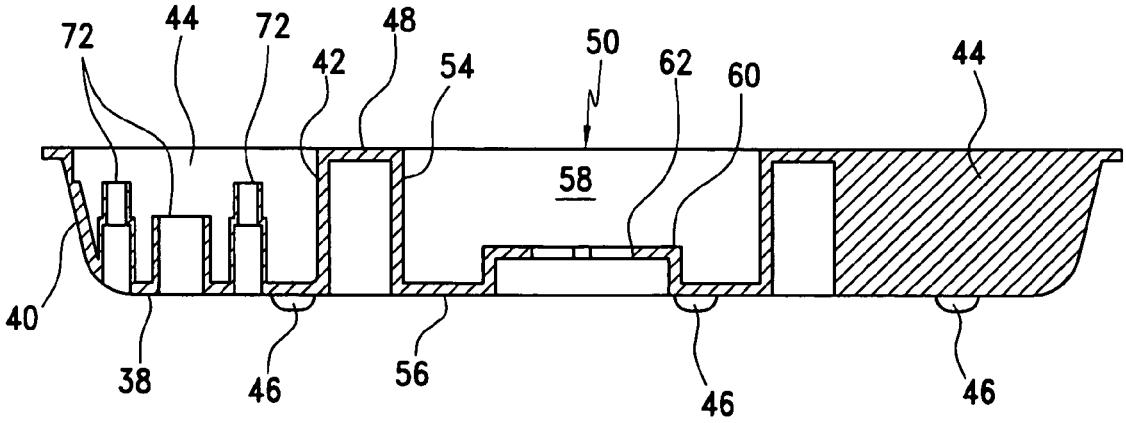
FIG. 7 is a cross sectional view of the base shown in FIG. 6 taken along the line 7—7.

Referring to FIGS. 6 and 7, base 12 includes an annular lower wall 38, an outer wall 40 having a circular cross section and extending upward from an outer edge of the lower wall 38, a first substantially cylindrical inner wall 42 spaced from the outer wall 40 and a plurality of fins or dividers 44 extending between the outer wall 40 and the first inner wall 42 for partitioning the space defined by the lower wall 38, the outer wall 40 and the inner wall 42 into the compartments 14. The number of fins 44 may be selected as desired to provide varying numbers of compartments 14 around the circumference of the base 12. Further, the fins 44 may be variably spaced around the base 12 to provide compartments 14 having different sizes as shown. Instead of a plurality of fins 44, other constructions for partitioning the space between the outer wall 40 and inner wall 42 may be used in accordance with the invention.

Lower wall 38 has a substantially planar lower surface to enable the dispenser 10 to rest on flat, horizontal surfaces and is optionally provided with pads 46 to slightly elevate the dispenser 10 above the horizontal surface (see FIG. 7).

An annular upper wall 48 is contiguous with and extends inward from an upper circular edge of the first inner wall 42 and defines a central opening 50. Upper wall 48 may include integral or separate indicia 52 for the timed dosage of pills received in the compartments 14. For example, the indicia may be marked on the upper wall 48 using a writing implement such as an erasable marker. Possible indicia include the days of the week with each day of the week being associated with one or more compartments and/or different periods of time with each period of time being associated with one of the compartments 14. In the illustrated embodiment, the indicia 52 is integrally formed in connection with the upper wall 48.

A second, substantially cylindrical inner wall 54 is contiguous with and extends downward from an inner circular edge of the upper wall 48 and an inner base wall 56 is contiguous with and extends inward from a lower, inner edge of the cylindrical inner wall 54. A lower surface of the inner base wall 56 is co-planar with the lower surface of the lower wall 38. A cavity 58 is thus formed in the base 12 by the cylindrical inner wall 54 and the inner base wall 56 and extends from the opening 50 in the upper wall 48.

A projection 60 is formed on the inner base wall 56 and has an upper surface elevated above the inner base wall 56.

An opening 62 is formed on the upper surface of the projection 60 and is generally circular with a distinct pattern of outward indentations 64 (see FIG. 6). The pattern of indentations 64 is designed to facilitate removable attachment of the retaining member 20 to the base 12 (discussed more fully below).

Base 12 may be made of a rigid material such as a rigid plastic and may be formed as a unitary structure or interconnected parts. The indicia 52 may be integrally formed in a color different than the color of the remaining portion of the base 12 to provide contrast to the indicia and enable them to be clearly viewed.

To enable the base 12 to be releasably mated with the cover member 16, a lip 66 is formed extending outward from an upper peripheral edge of the outer wall 40 and a recess 68, having substantially the same size as the flange 34 on the circular rim 36, is formed in the lip 66 at one circumferential location (see FIG. 6). Attachment of the cover member 16 to the base 12 entails aligning the flange 34 with the recess 68, placing the cover member 16 onto the base 12 and then rotating the cover member 16 relative to the base 12 (or vice versa) until the flange 34 moves away from the recess 68 to a position below the lip 66. Instead of a single recess 68, a plurality of recesses each having a different size can be provided if a plurality of flanges 34 are provided on the cover member 16 (as in the illustrated embodiment). Other mechanisms for providing removable engagement of the cover member 16 to the base 12 are also envisioned for the invention.

In use, prior to engagement of the cover member 16 with the base 12, one or more pills would be placed into the compartments 14 in accordance with the dosage regimen.

A push member 70 (also referred to as a stopper/safety lock button) is arranged on the base instead of one of the compartments 14 and is movable by pushing downward between an upper, transport or non-use position in which it projects through the opening in the cover member 26 and a lower position in which it is situated below the cover member 16, i.e., to enable unimpeded rotation of the cover member 16 relative to the base 12. The construction of a push member 70 which is alternatively movable between lower and upper positions upon exerting a downward pressure against it is known in the art. Push member 70 engages with mounting projections 72 formed on the base 12 (see FIG. 7). When attaching the cover member 16 to the base 12, the push member 70 is depressed into its lower position and thereafter, the cover member 16 is positioned with flange 34 aligning with the recess 68.

Figure 8:
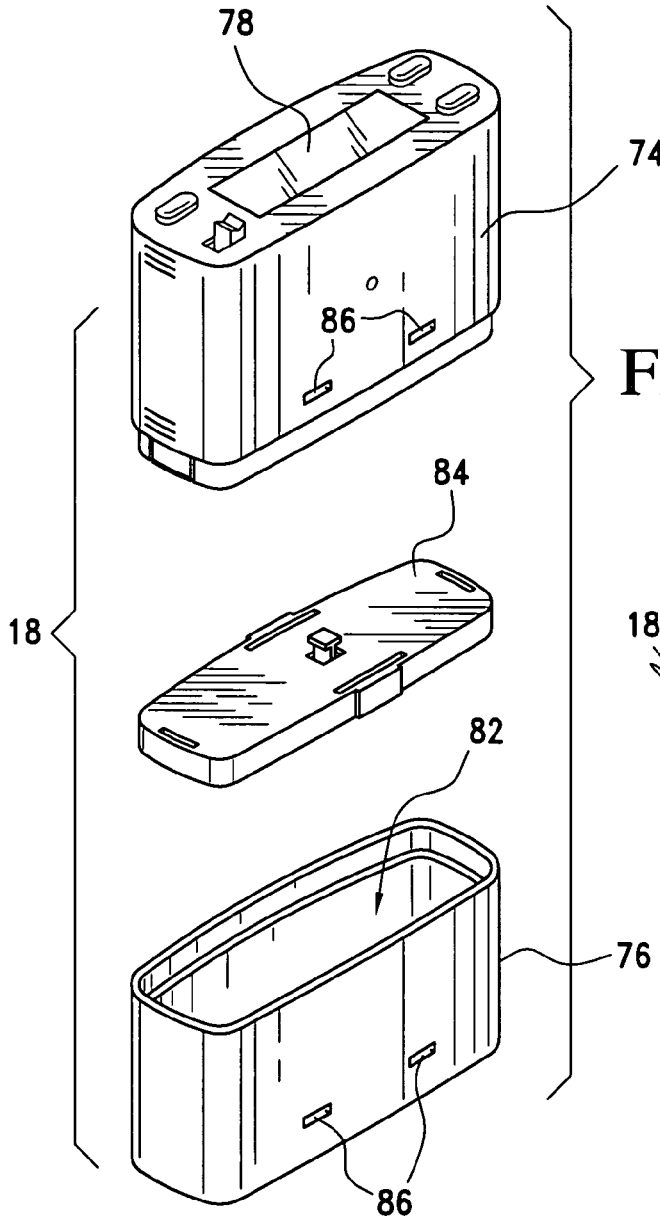
FIG. 8 is an exploded view of a removable pill holder including a clock/alarm/timer for use in the pill dispenser shown in FIG. 1.

Referring now to FIG. 8, the pill holder 18, including the clock/alarm/timer unit, comprises an upper electronic housing 74 and a lower pill-receiving housing 76. The electronic housing 74 includes a LCD display 78 and various buttons which enable one or more electronic components in the housing 74 to cause the LCD display 78 to display the time and to allow for programing the electronic component(s) in the housing 74 to set the time and optionally cause an alarm to sound, or a light to flash, at a set time or set times. Such electronic components are known in the art.

The clock/alarm/timer unit includes a pill timer setting which allows the user to set the time at which the user would like to be alerted to take pills. At the time pills are to be taken, an alert is activated (audible, visual or both). The clock/alarm/timer unit will continue to activate the alert for up to 25 hours if the pills are not taken.

Housing 76 defines an interior compartment 82 in which pills can be stored, in particular pills which are sensitive to light, and in which money can also be stored for emergency use. Access to the pills or money in the compartment 82 is gained by separating the electronic housing 74 from the pill-receiving housing 76, i.e., pulling them away from each other.

A removable plunger 84 is arranged in the housing 76 and is used to prevent pills from rattling around in the housing 76. To place pills into housing 76, the plunger 84 is removed, the pills are placed into housing 76 and then the plunger 84 is pushed down against the pills so that the pills will not be able to rattle or jingle during movement of the pill holder 18.

The pill holder 18 includes recesses 86 on one or more outer surfaces (see FIG. 8). Recesses 86 are designed to accommodate projections 88 on the retaining member 20 (see FIGS. 9 and 11) to thereby prevent inadvertent separation of the pill holder 18 from the retaining member 20. Alternative mechanisms for detachably coupling the pill holder 18 to the retaining member 20 are also envisioned in the invention, for example, the formation of recesses on the retaining member 20 and corresponding projections on the pill holder 18.

Figure 8A:
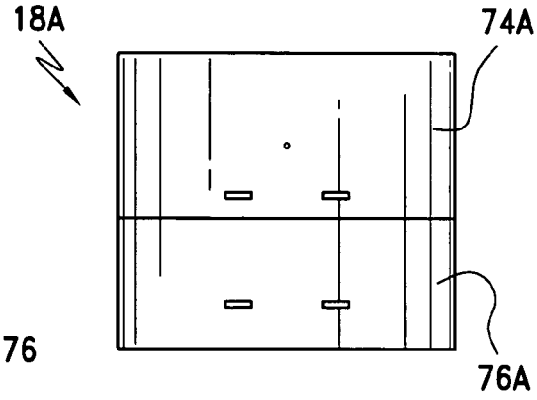
FIG. 8A is a side view of a removable, travel pill holder for use in the pill dispenser shown in FIG. 1.
Figure 8B:
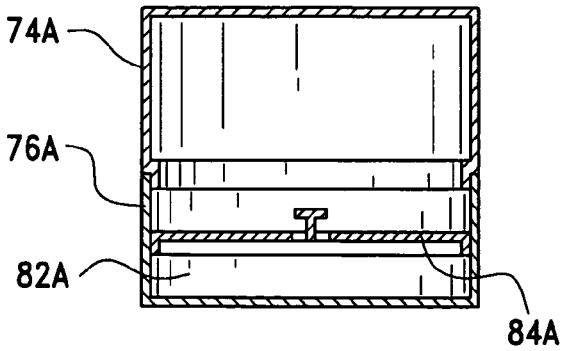
FIG. 8B is a cross-sectional view of the travel pill holder shown in FIG. 8A.
Figure 9:
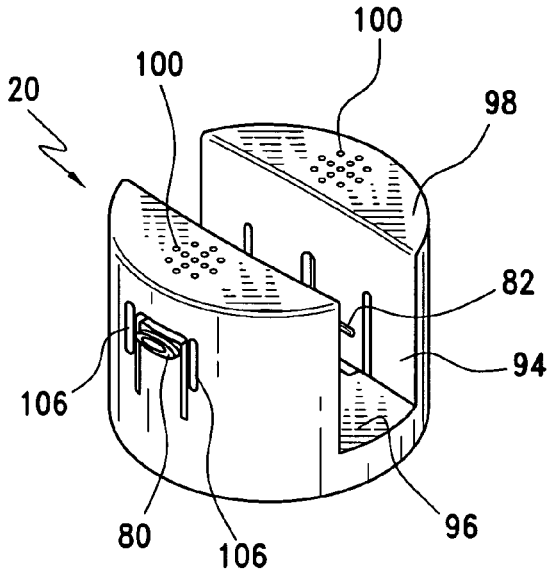
FIG. 9 is a perspective view of a pill holder retaining member of the pill dispenser shown in FIG. 1.
Figure 11:
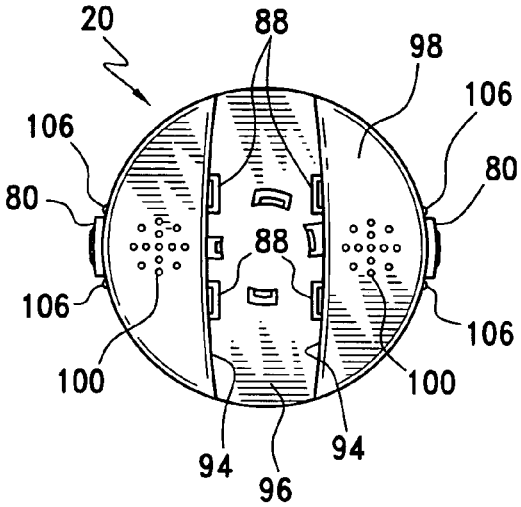
FIG. 11 is a top view of the pill holder retaining member shown in FIG. 9.
Figure 10:
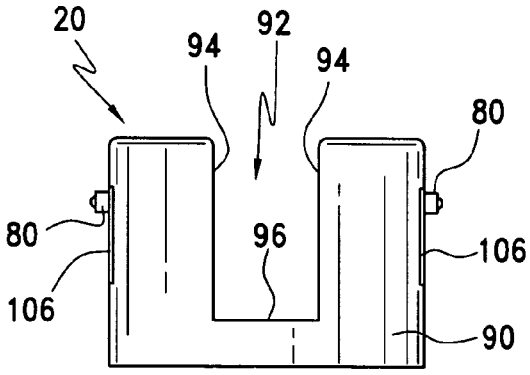
FIG. 10 is a side view of the pill holder retaining member shown in FIG. 9.
Figure 12:
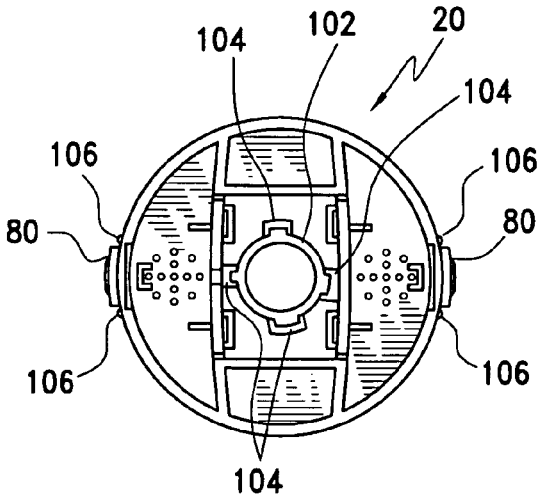
FIG. 12 is a bottom view of the pill holder retaining member shown in FIG. 9.

FIGS. 8A and 8B show a pill holder 18A which does not include a clock/alarm/timer unit. Pill holder 18A include an upper housing 74A and a lower pill-receiving housing 76A defining an interior compartment 82A in which pills and/or money can be stored. A removable plunger 84A is arranged in the housing 76A.

Referring now to FIGS. 9–12, the retaining member 20 includes a cylindrical outer wall 90 having a slot 92 extending from one side to an opposite side through a center of the retaining member 20. The slot 92 is defined by opposed interior walls 94 and a bottom wall 96. Interior walls 94 include the projections 88 which pass into the recess 86 on the pill holder 18 to maintain the connection between the retaining member 20 and the pill holder 18. A bifurcated upper wall 98 of the retaining member 20 includes two sets of apertures 100 to allow sound from the clock/alarm/timer unit of the pill holder 18 to pass therethrough.

The retaining member 20 is designed to fit in the cavity 58 in the base 12 and releasably attach to the base 12. To this end, the retaining member 20 includes a cylindrical projection 102 extending downward from the bottom wall 96 and having a pattern of flanges 104 which correspond to the pattern of indentations 64 formed on the upper surface of the projection 60 of the base 12. In the illustrated embodiment, the pattern of indentations 64 includes four indentations, each having a different size whereas the pattern of flanges 104 includes four flanges each having a size correspond to the size of a respective indentation 64 and being arranged in the same relative orientation to the indentations 64. As such, the retaining member 20 can be engaged with the base 12 by aligning the flanges 104 with the indentations 64 and then lowering the retaining member 20 onto the base 12 and rotating the retaining member 20 relative to the base 12 (or vice versa). Although the retaining member 20, when engaged with the base 12, is rotatable relative to the base 12, it cannot be separated from the base 12 unless it is rotated into a position in which the flanges 104 align with the indentations 64. Other mechanisms for detachably connecting the retaining member 20 to the base 12 are also envisioned in the invention.

When attached to the base 12, the retaining member 20 is also releasably attached to the cover member 16. This is achieved by providing flexible tabs 80 on opposite sides of the outer wall 90 which are designed to pass into the apertures 30 on the cover member 16 when the retaining member 20 is engaged with the base 12. Elongate projections 106 are formed alongside the tabs 80 and pass into the channels 32 formed alongside the apertures 30. Once the retaining member 20 is coupled to the cover member 16 via the tabs 80 and apertures 30, the retaining member 20 is rotated together with the cover member 16. However, it is possible to remove the cover member 16 while the retaining member 20 is attached to the base 12 by pressing the tabs 80 inward while lifting the cover member 16 upward (when the flange 34 aligns with the recess 68).

In use, the cover member 16 is removed out of engagement with the base 12 and pills are placed in some or all of the compartments 14. The pills are placed into only those compartments 14 which correspond to the time and day on which the pills must be taken, the time and day being designated on the indicia 50 in alignment with the compartments 14. The cover member 16 is then reattached to the base 12 and rotated until the access opening 24 aligns with the push member 70 which is then depressed to bring it to its upper position.

In the alternative, it is possible to first attach the cover member 16 to the base 12 and then, while the push member 70 is depressed into its lower position, rotate the cover member 16 so that it sequentially aligns with each of the compartments 14. Pills are placed into each compartment 14 through the access opening 24 in the cover member 16.

When it is desired to removed pills from one of the compartments 14 (which can be readily ascertained by viewing the time on the LCD display 78 of the clock/timer unit of the pill holder 18 in the center of the dispenser 10), the push member 70 is depressed into its lower position, the cover member 16 is rotated until the access opening 24 aligns with the compartment 14 having the desired pill(s) and the pills are then removed from that compartment 14. The cover member 16 is then rotated until the access opening 24 aligns with the push member 70 which is then depressed to bring it to its upper position. This pill dispensing procedure continues over a series of pill-taking times, such as several days, a week or a month, until the pills in the compartments 14 are removed at which time the compartments 14 may be refilled in either method described above.

The foregoing construction of the dispenser 10 provides for easy dispensing of one or more pills in individual dosages when placed in the compartments 14. The presence of the pill holder 18, including the clock/alarm/timer unit, in the center of the dispenser 10 enables the user to readily see whether it is the appropriate time to take a dosage of pills from one of the compartments 14 and can also set an alarm to be notified when it is the time to take a dosage of pills and be reminded up to 25 hours if pills are not timely taken, or at least not removed from the dispenser 10.

Referring now to FIGS. 13–21B, another embodiment of a pill dispenser in accordance with the invention is designated generally as 110 and comprises a generally circular base 112 having an interior space 114, a dispenser member 116 arranged in the interior space 114 of the base 112 to partition the interior space 114 into pill-receiving compartments 118 spaced circumferentially around the base 112 and a dispensing tray 120*a*, 120*b* removably engaging with the base 12 and including a pill-receiving cavity 122.

An annular cover member 124 is arranged against the dispenser member 16 to close the compartments 118. The cover member 124 may be formed of a rigid, transparent material such as clear plastic or glass to enable the contents of the compartments 118 to be visible.

The base 112 includes dispensing slots 126*a*, 126*b* formed on two sides of the base 112. The dispensing trays 120*a*, 120*b* are positionable in alignment with the slots 126*a*, 126*b* so that as the dispenser wheel 116 rotates, each compartment 118 is positioned in alignment with the slots 126*a*, 126*b* and any pills contained in the compartment 118 fall through the slots 126*a*, 126*b* into the dispensing tray 120*a*, 120*b*. The dispensing tray 120*a*, 120*b* is then removed from the base 112 to access the pills therein.

The slots 126*a*, 126*b* are formed in two walls of the base 112 which are substantially perpendicular to one another and this enables the dispenser 110 to be used in either a vertical orientation or a horizontal orientation.

Figure 13:
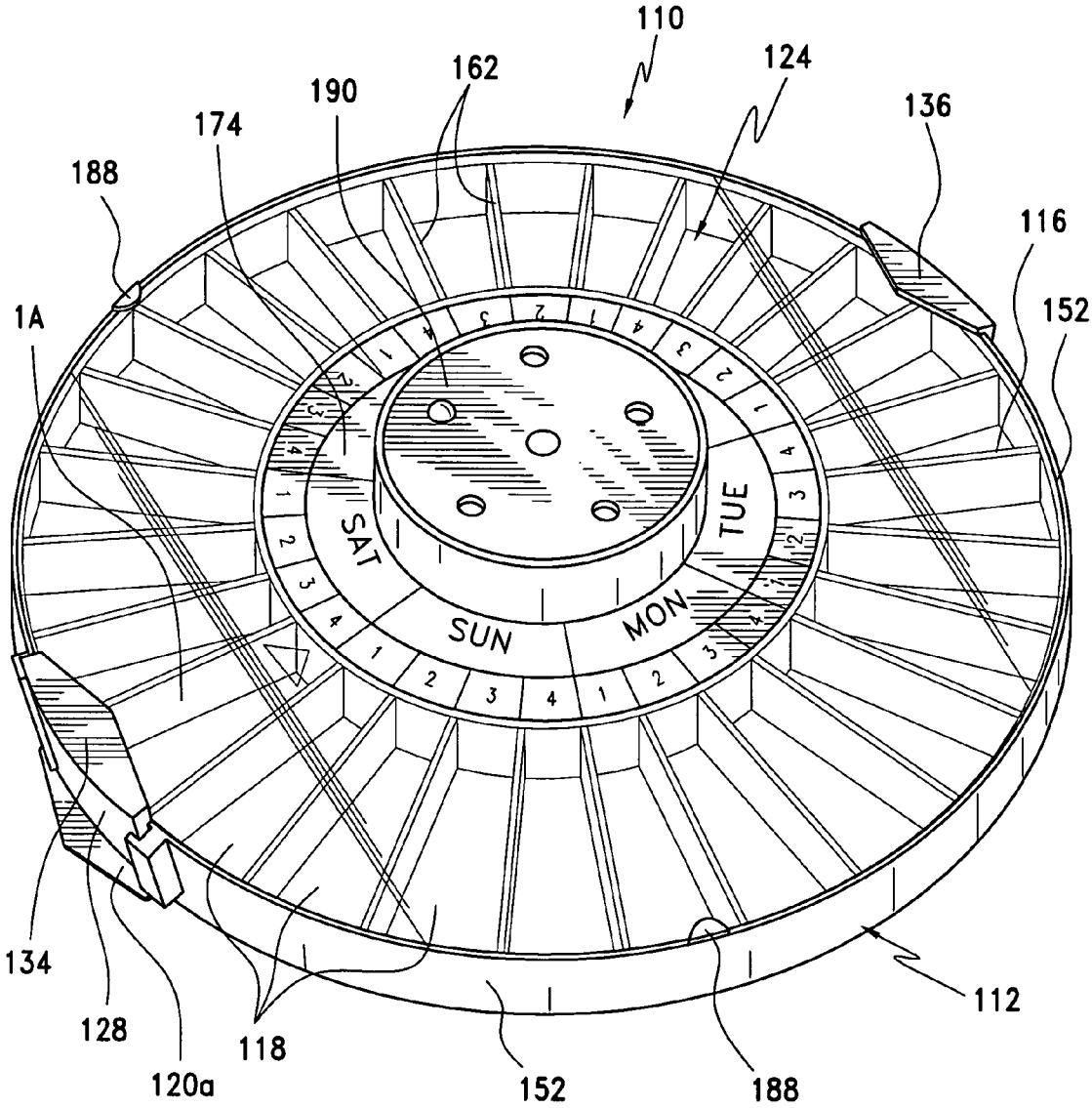
FIG. 13 is a perspective view of a second embodiment of a pill dispenser in accordance with the invention.
Figure 14:
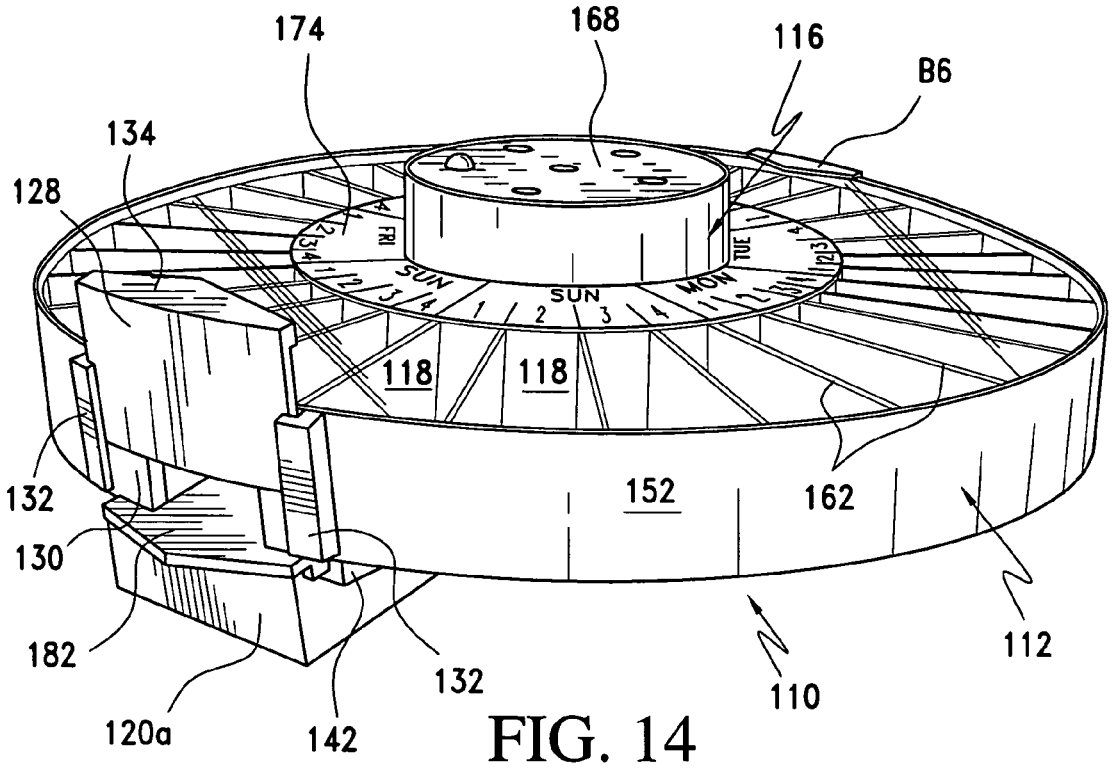
FIG. 14 is a perspective view showing the pill dispenser of FIG. 13 with a locking tab partially removed from a corresponding slot.
Figure 15:
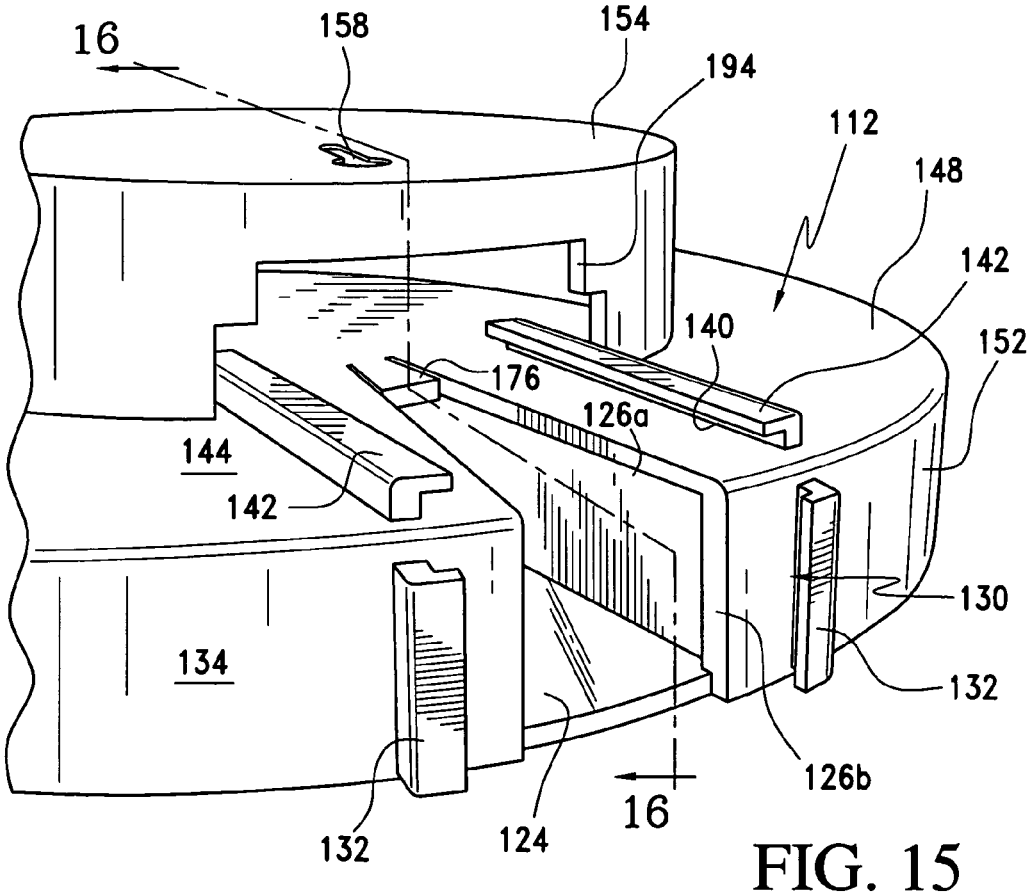
FIG. 15 is a view of the bottom of the pill dispenser shown in FIG. 13 rotated 180 degrees.

In the horizontal orientation shown in FIG. 13, the dispensing tray 120*a* is arranged in engagement with the base 112 and a closing plate 128 is provided to close the slot 126*b*. The plate 128 is placed into an arcuate slot 130 formed by projecting rails 132 on an outer surface of the base 112. Plate 128 has an arcuate form to enable it to fit in the slot 130 and includes an upper, inwardly projecting tab 134 which projects over the cover member 124 to thereby secure the cover member 124 in the dispenser 110. The tab 134 may be designed to secure the cover member 124 against the dispenser member 116 and/or base 112.

Another tab 136 is formed on the base 112 diametrically opposite tab 134 and also serves to secure the cover member 124 against the dispenser member 116 and/or to the base 112. Different forms and number of tabs may be used to secure the cover member 124 against the dispenser member 116 and/or to the base 112. Other constructions for securing the cover member 124 to the base 112 and/or against the dispenser member 116 may also be provided in the invention.

In the horizontal orientation, the dispensing tray 120*a* is insertable into engagement with the base 112 so that the cavity 122 in dispensing tray 120*a* aligns with the slot 126*a*. In this position, any pills in the compartment 118 aligning with the slot 126*a* fall into the cavity 122 and can be retrieved when the dispensing tray 120*a* is fully removed from engagement with the base 112.

Figure 18:
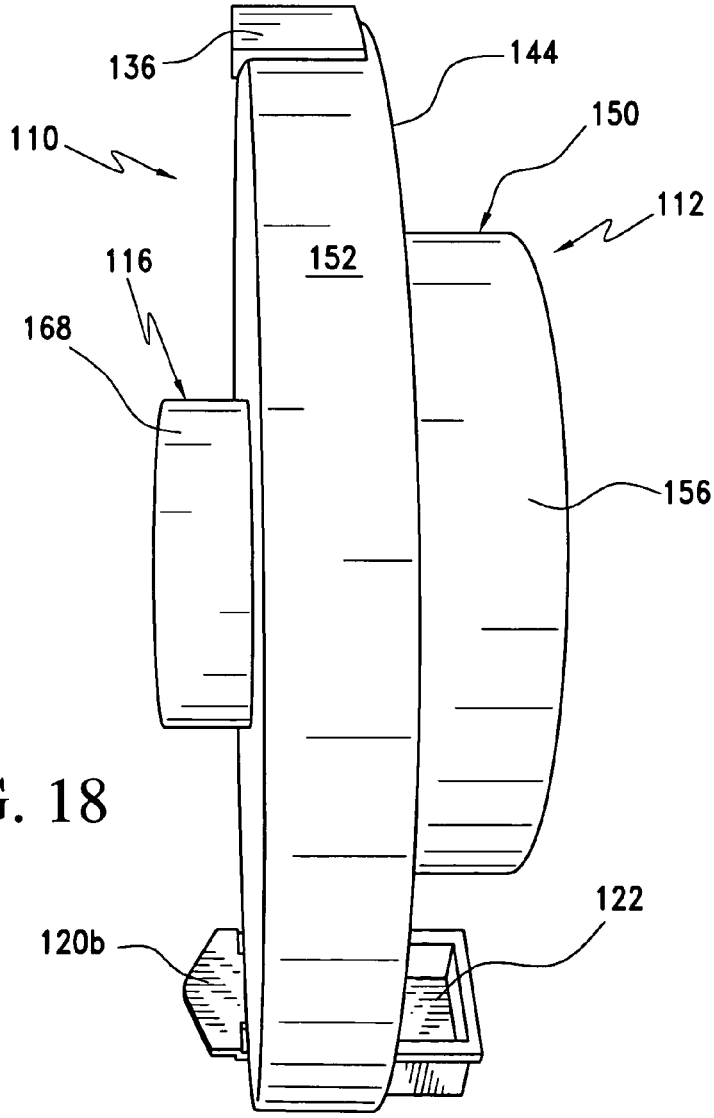
FIG. 18 is a side view of the pill dispenser shown in FIG. 13 when configured for vertical use.
Figure 19:
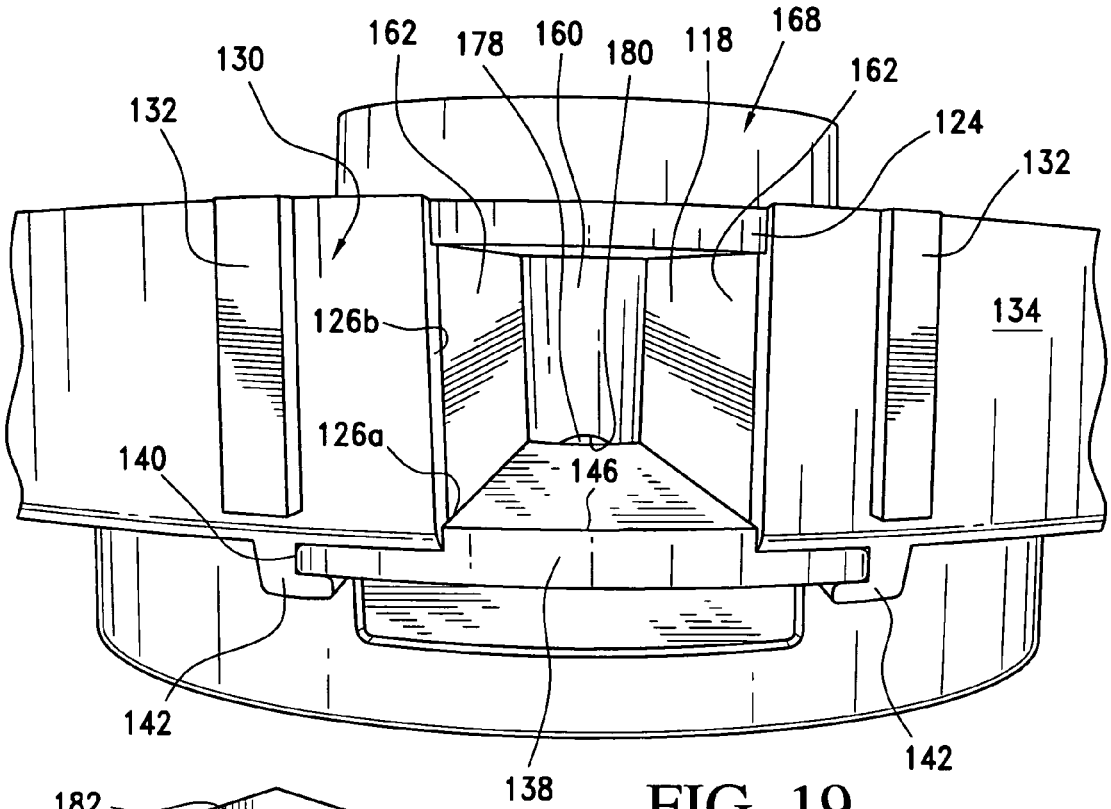
FIG. 19 is a bottom view of the pill dispenser shown in FIG. 13 when configured for vertical use and with the dispensing tray removed.

In the vertical orientation shown in FIGS. 18 and 19, the dispenser 110 will be positioned in an upright position with the base 112 against the wall or other vertical surface. The dispensing tray 120*b* is arranged in engagement with the base 112 and a closing plate 138 is provided to close the slot 126*a*. The plate 138 is placed into a slot 140 formed by projecting rails 142 on a lower surface 144 of the base 112. Plate 138 has a wedge-shaped form to enable it to fit in the slot 140 and includes a raised ledge 146 which enters into the slot 126*a* (see FIG. 18). The plate 138 is designed to frictionally engage the slot 140 and/or the ledge 146 is designed to frictionally engage the slot 126*a* so that the plate 138 does not fall out of the slot 140 when the dispenser 110 is mounted in the vertical orientation.

The dispensing tray 120*b* is insertable into engagement with the base 112 so that the cavity 122 in dispensing tray 120*b* aligns with the slot 126*b*. In this position, any pills in the compartment 18 aligning with the slot 126*b* fall into the cavity 122 and can be retrieved when the dispensing tray 120*b* is fully removed from engagement with the base 112.

The dispensing trays 120*a*, 120*b* are thus alternatively arranged in engagement with the base 112 depending on the desired orientation of the dispenser 110. The dispenser 110 may be manufactured to include a base 112 having both slots 126*a*, 126*b*, both dispensing trays 120*a*, 120*b* and both closing plates 128, 138 with the understanding that dispensing tray 120*a* is used in conjunction with slot 126*a* and closing plate 128 and dispensing tray 120*b* is used in conjunction with slot 126*b* and closing plate 138. In the alternative, it is entirely conceivable to manufacture a pill dispenser including a base having only one slot and associated dispensing tray, or including more than two slots, each slot having an associated dispensing tray, and the required number of closing plates to close the slots.

Figure 16:
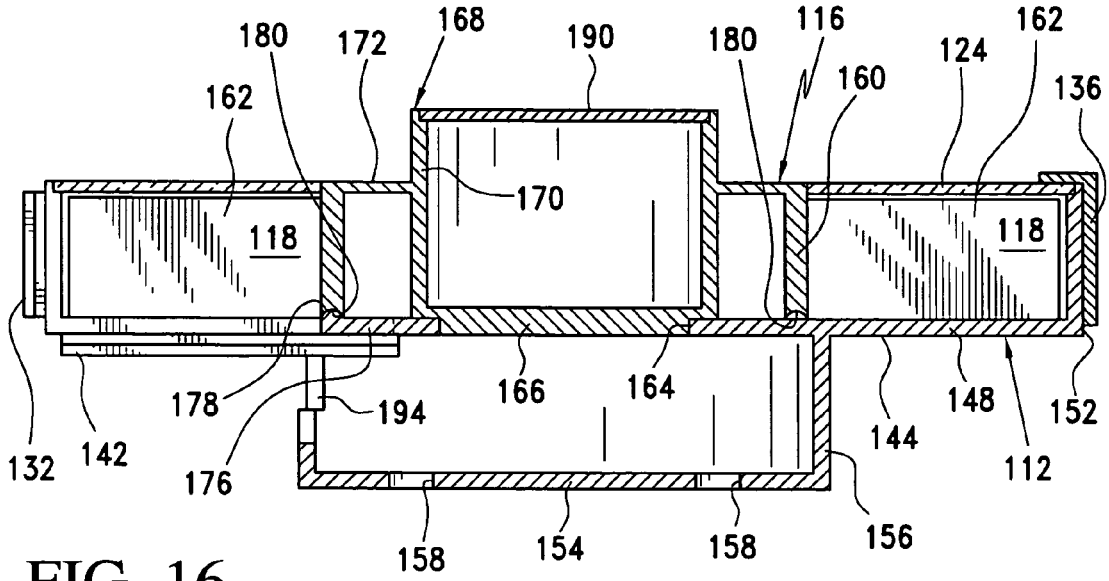
FIG. 16 is a cross sectional view of the pill dispenser shown in FIG. 13 taken along the line 16—16 in FIG. 15.
Figure 17A:
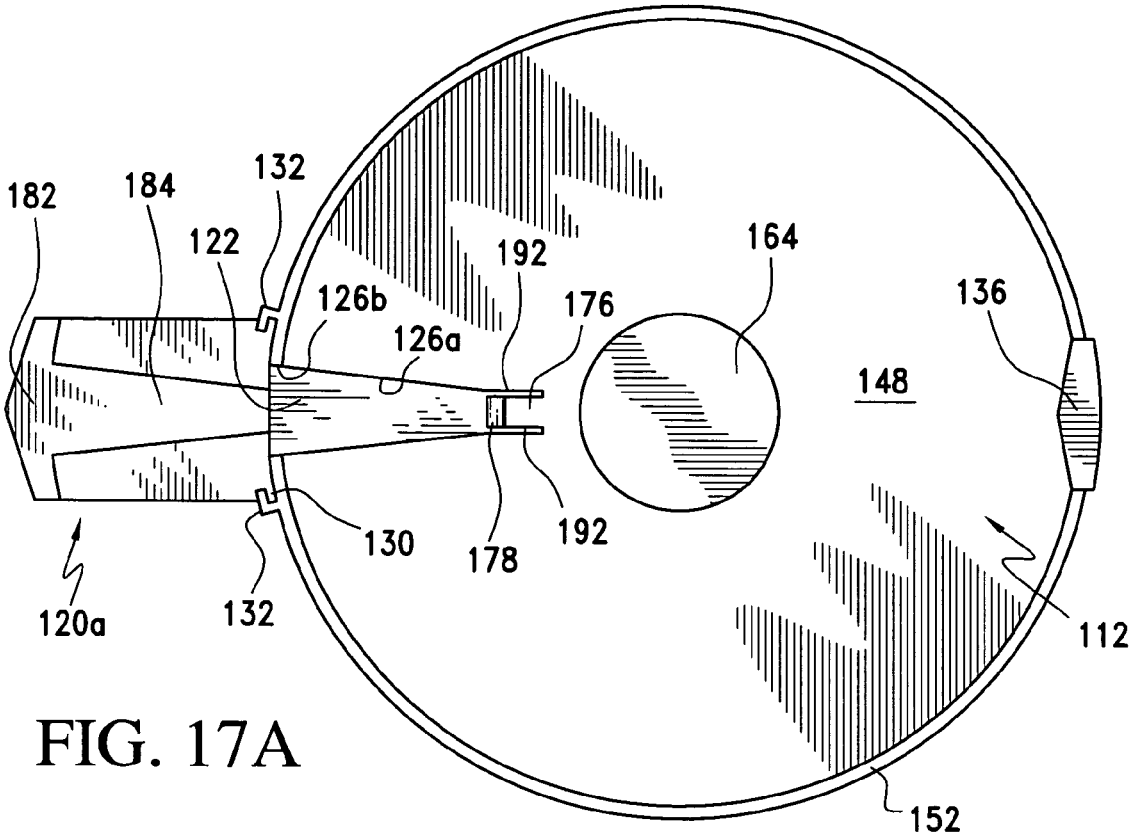
FIG. 17A is a top view of the base of the pill dispenser shown in FIG. 13 with a dispensing tray.
Figure 17B:
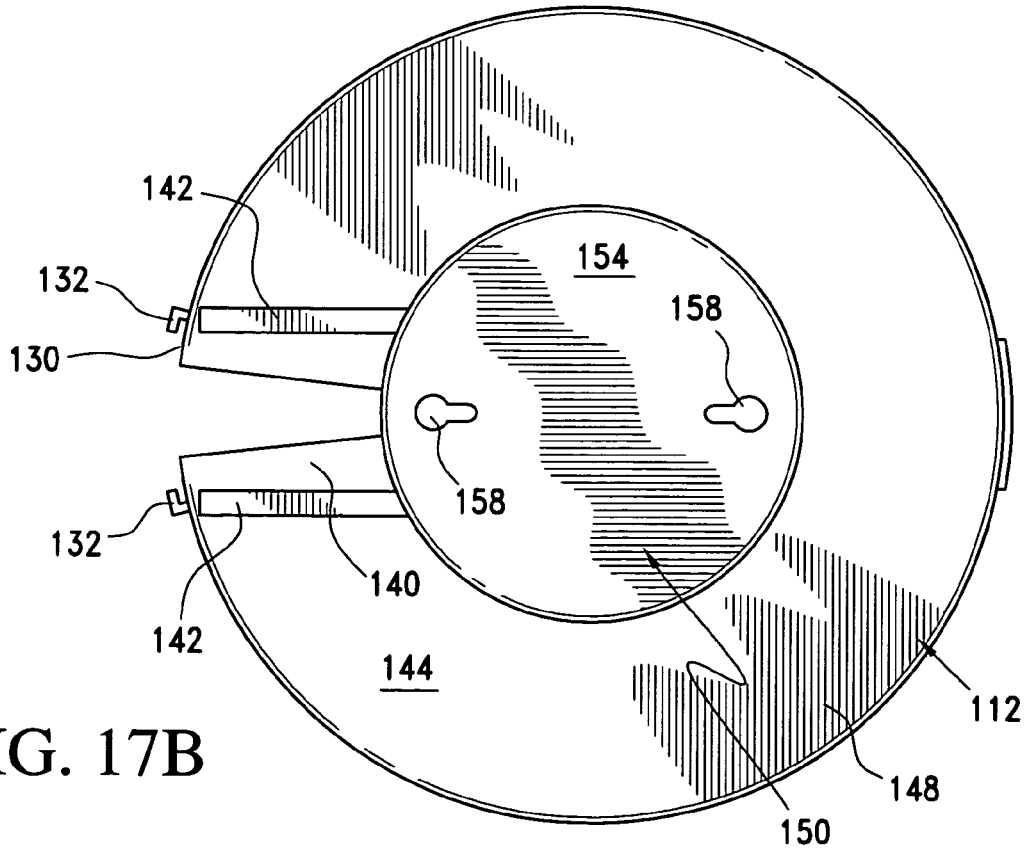
FIG. 17B is a bottom view of the base of the pill dispenser shown in FIG. 13.

Referring now in particular to FIGS. 16, 17A and 17B, base 112 comprises a circular support wall 148 defining a bottom of the interior space 114, a supporting section 150 extending from a lower surface 144 of the support wall 148 and a cylindrical rim 152 extending upward from a peripheral edge of the support wall 148 and defining a side of the interior space 114. The rim 152 has a ledge 192 for receiving the cover member 124. The slot 126*a* is formed in the support wall 148. The supporting section 150 includes a bottom planar wall 154 and a cylindrical wall 156 extending between the bottom wall 154 and the support wall 148. The bottom wall 154 enables the dispenser 110 to rest securely on a flat surface. The cylindrical wall 156 includes an opening 194 to enable the dispensing tray 126*a* to be inserted into engagement with the base 112.

The bottom wall 154 includes mounting holes 158 which enable the dispenser 110 to be mounted to the wall or other vertical surface by inserting screws, nails and the like through the mounting holes 158 and into the wall or other vertical surface. Although the bottom wall 154 is shown with two mounting holes 158 (FIG. 17B), any number of mounting holes 158 may be provided and moreover, instead of mounting holes 158, other mechanisms for attaching the bottom wall 154 to a vertical surface may be arranged on the bottom wall 154 for example, adhesive strips.

The dispenser member 116 is arranged in the interior space defined by the support wall 148 and the rim 152. The dispenser member 116 takes the form of a dispenser wheel and includes an outer cylindrical wall 160 and radial fins 162 extending from the cylindrical wall 160 to thereby form the compartments 118 radially spaced around the circumference of the base 112. The fins 162 may be fixed to the outer cylindrical wall 160 or detachable from the outer cylindrical wall 160. In the latter case, varying numbers of compartments and/or compartments of different sizes can be provided.

Instead of a dispenser wheel, other constructions including interconnected radial fins can be used to partition the interior space 114 into individual compartments 118.

To facilitate rotation of the dispenser member 116, the support wall 148 of the base 112 includes a central aperture 164 having a diameter slightly larger than a diameter of a base 166 of the dispenser member 116 so that the base 166 of the dispenser member 116 fits in the aperture 164 (see FIG. 16).

The dispenser member 116 also includes a handle portion 168, constituted by an inner cylindrical wall 170 extending from the base 166, which enables manual handling and rotation of the dispenser member 116 relative to the base 112. A ledge 172 is formed between the outer and inner cylindrical walls 160, 170 and supports dosage indicia 174. The dosage indicia 174 may be integral with or separate from the ledge 172.

The dispenser 110 may include electronic components and an electronic display, buttons and the like in the cavity defined by the inner cylindrical wall 170. Such electronic components would be mounted in the cavity of compartment defined by cylindrical wall 170 and the controls, display, etc. could be mounted in connection with the plate 190 (see FIG. 13 which shows LED display, lights, etc.). The electronic components can be designed to perform a variety of functions relating to the dispensing of the pills, including for example, to emit an audible tone at each dosage time. Also, there are buttons, LED display lights, optionally a clock or timer unit and display, etc. on the plate 190. Buttons, for example, can be pressed to stop an alarm signal. Also, pressing an appropriate "stop" button will automatically advise when the next pills are to be taken. The electronic control can include a transmitter that sends information to a receiver in a remote device, such as a Telemergency® unit, advising others, including advising by telephone, that pill dosages were not taken as required.

The retaining member 20 and the pill holder 18 with optional clock/timer unit described above could also be arranged in the cavity in the inner cylindrical wall 170.

A detent mechanism is provided to position the dispenser member 116 only in pre-determined positions relative to the base 112. The detent mechanism includes a flap portion 176 of the support wall 148 which is formed at an inner edge of the slot 126*a*. A raised projection 178 is arranged on the flap 176. To provide the flap 176 with resiliency, slits 192 are formed on the sides of the flap 176.

The detent mechanism also includes notches 180 formed in the lower surface of the outer cylindrical wall 160 of the dispenser member 116, each in a position to place a respective one of the compartments 118 in alignment with the slots 126*a*, 126*b* (see FIG. 16). The projection 178 and notches 180 are dimensioned such that the when the projection 178 is in a notch 180, the application of a force is required to move the dispenser member 116. As such, the dispenser member 116 can be manually rotated and whenever the projection 178 enters into a notch 180, this entry will be sensed and rotation of the dispenser member 116 stopped. In this position, one of the compartments 118, i.e., the compartment 118 in whose aligning notch 180 the projection 178 is situated, will be present in the pill-dispensing position A in alignment with the slots 126*a*, 126*b* (see FIG. 16).

Other mechanisms can be arranged on the base 112 and/or the dispenser wheel 16 to limit the stable positions of the dispenser member 116 relative to the base 12 only to those positions in which one of the compartments 118 will be in alignment with the slots 126*a*, 126*b*.

With respect to insertion of the dispensing trays 120*a*, 120*b* into engagement with the base 112, guide mechanisms are formed on the base 112 for guiding the insertion and removal of the dispensing trays 120*a*, 120*b*. For guiding the dispensing tray 120*a*, the same projecting rails 142 on the lower surface 144 of the support wall 148 are used. The dispensing tray 120*a* is thus slidable into the slot 140 defined between the rails 142. For guiding the dispensing tray 120*b*, the same projecting rails 132 on the outer surface 134 of the rim 152 are used. The dispensing tray 120*b* is thus slidable into the slot 130 defined between the rails 132.

Figure 20A:
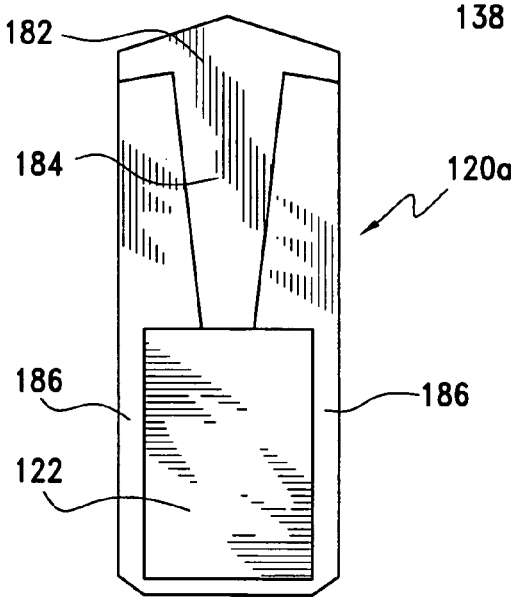
FIG. 20A is a top view of a one embodiment of a dispensing tray for the pill dispenser shown in FIG. 13.
Figure 20B:
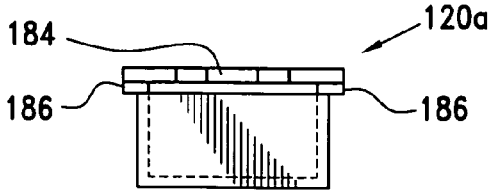
FIG. 20B is a side view of the dispensing tray shown in FIG. 20A.

Referring now to FIGS. 20A and 20B, the dispensing tray 120*a* for use in the horizontal orientation of the dispenser 110 includes a pill-receiving cavity 122 formed in the upper surface at one end, a pull tab 182 formed at an opposite end and a raised ledge 184 formed on the upper surface between the cavity 122 and the pull tab 182. A tongue 186 is formed along each edge of the upper surface, as shown in FIG. 20B.

The dispensing tray 120*a* is designed to fit in the slot 140 formed between the rails 142 on the lower surface 144 of the support wall 148 by positioning each tongue 186 on a respective rail 142. The ledge 184 is designed to close the slot 126*a* when the dispensing tray 120*a* is fully inserted into the slot 140 (FIG. 13).

Figure 21A:
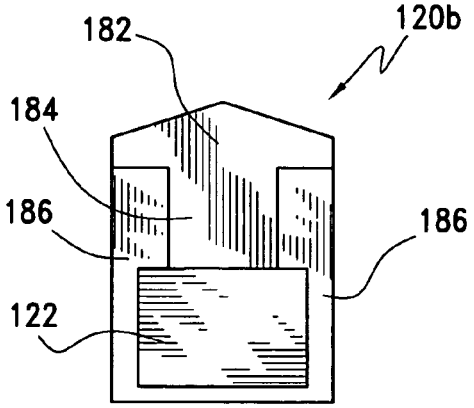
FIG. 21A is a top view of another embodiment of a dispensing tray for the pill dispenser shown in FIG. 13.
Figure 21B:
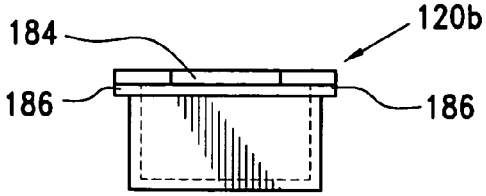
FIG. 21B is a side view of the dispensing tray shown in FIG. 21A.

Referring now to FIGS. 21A and 21B, the dispensing tray 120*b* for use in the vertical orientation of the dispenser 110 includes a pill-receiving cavity 122 formed in the upper surface at one end, a pull tab 182 formed at an opposite end and a raised ledge 184 formed on the upper surface between the cavity 122 and the pull tab 182. A tongue 186 is formed along each edge of the upper surface, as shown in FIG. 21B. The dispensing tray 120*b* is designed to fit in the slot 130 formed between the rails 132 on the outer arcuate surface 134 of the peripheral rim 152 by positioning each tongue 186 on a respective rail 142.

The upper surface of the dispensing tray 120*b* has an arcuate shape as shown in FIG. 21B corresponding to the circular form of the rim 152. Also, the ledge 184 is designed to close the slot 126*b* when the dispensing tray 120*b* is fully inserted into the slot 30 (FIG. 18).

Positioning tabs 188 are arranged at an upper peripheral edge of the rim 152 at several locations around the periphery of the rim 152, including one below the tab 136. Tabs 182 serve to prevent rotation of the cover member 124.

In use, to dispense pills after they are placed into the compartments 118, the dispenser member 116 is turned until the compartment 118 in which the pills desired to be dispensed is positioned in the pill-dispensing position, i.e., the position in which the compartment 118 aligns with the slot 126*a*, 126*b*. This position is determined when the projection 718 on the base 112 enters into one of the notches 180 on the dispenser member 116 which can be sensed during the rotation of the dispenser member 116.

The dispensing tray 120*a*, 120*b* is then pulled outward, e.g., via the pull tab 182, so that as the cavity 122 is moved below the slot 126*a*, 126*b*, any pills in the compartment 118 in the pill-dispensing position fall into the cavity 122. Upon continued outward movement of the dispensing tray 120*a*, 120*b*, the dispensing tray 120*a*, 120*b* is removed entirely from the slot 126*a*, 126*b* and the pills can be obtained from the cavity 122. Thereafter, the dispensing tray 120*a*, 120*b* is re-inserted into the slot 126*a*, 126*b* and the dispenser 110 is ready for subsequent use.

An important feature of the embodiment of the invention described above, and of the embodiments described herein, is that when a person goes to the pill dispensing unit, they can automatically see if pills were taken appropriately and if they missed a dose. This can be seen through the clear top surface of the device so that the contents of each compartment can be seen by the user. If the user misses a dose, the pills or other medications need not be taken out of the device. They can be kept in the dispenser for future use, as desired. Thus, the dispenser of the present invention permits users or medical care personnel to determine that all of the pills or other medications have been appropriately taken. It is also possible to determine how many doses have been missed, as well as when future doses should be taken. These are important features of the present invention.

While the device is described above for persons who take multiple doses per day, so that the device is usable for one week before refilling is required, the device can also be used to dispense medication for a complete month. In such a case, the dosage indicia 174 can be replaced with another one showing the days of the month in registration with the compartments of the dispenser.

As mentioned above, the device of the present invention, by virtue of the clear upper cover member 124 thereof, permits a user or medical care personnel to see with their own eyes when and if the user has taken the appropriate medication, merely by looking at the unit. If the pills were appropriately taken, then the respective compartment is empty. If the pills were not appropriately taken, the pills will remain in the compartment and will tell the user or care personnel which dosage has been missed, as well as when the next dosage is due. This can be done electronically as well as visually as described above. In an electronic detection unit, when it is detected that pills have not been taken as required, the unit would include a transmitter to transmit to a remote device a signal indicating that a dosage has not been taken. The receiving device may be a unit such as a Telemergency® unit, which would telephone a pre-programmed person to inform that person or persons that the dosages of medication were not appropriately taken.

The features described above are also present in the other units of the present invention described herein.

Figure 22:
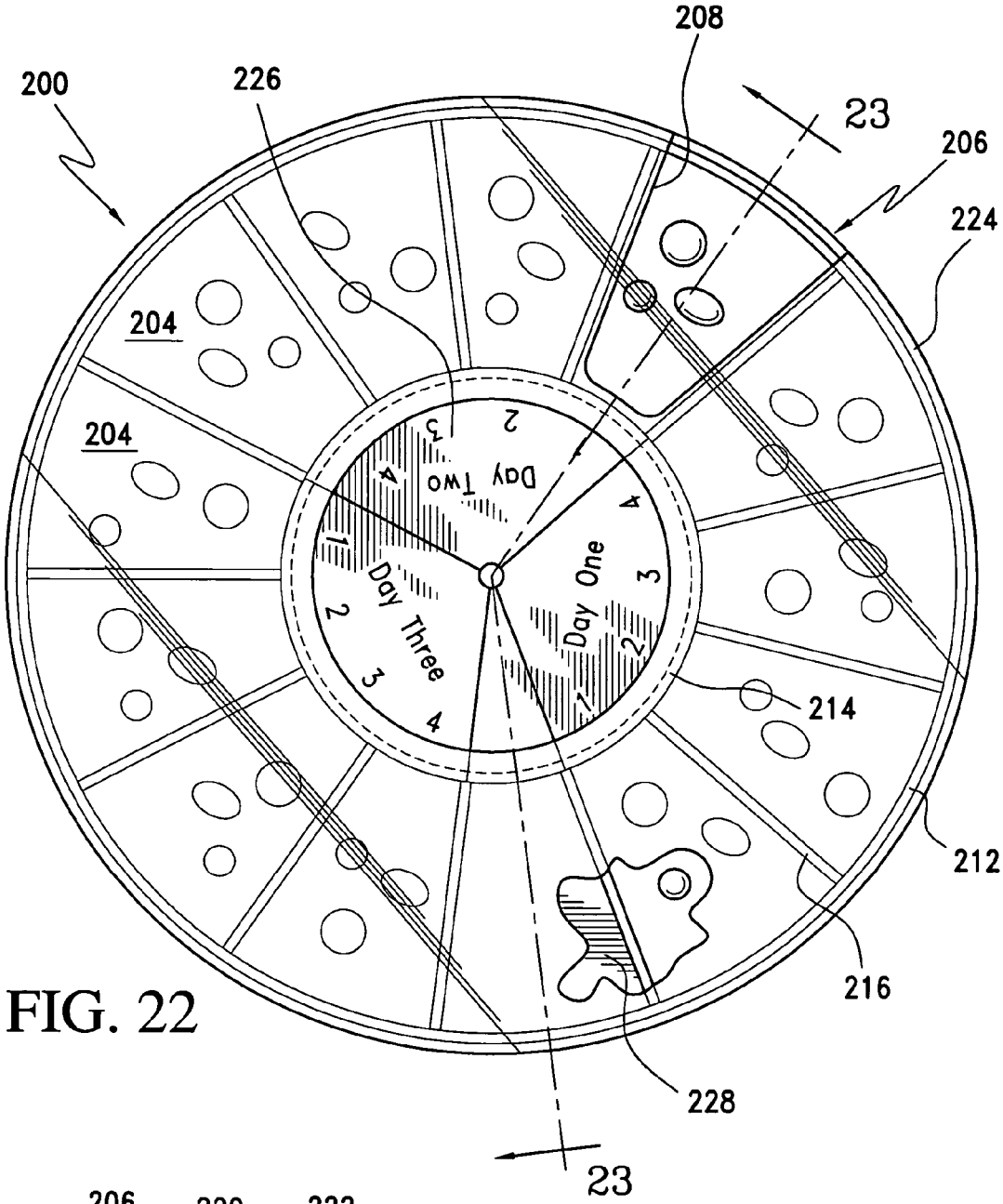
FIG. 22 is a top view of a third embodiment of a pill dispenser in accordance with the invention.
Figure 23:
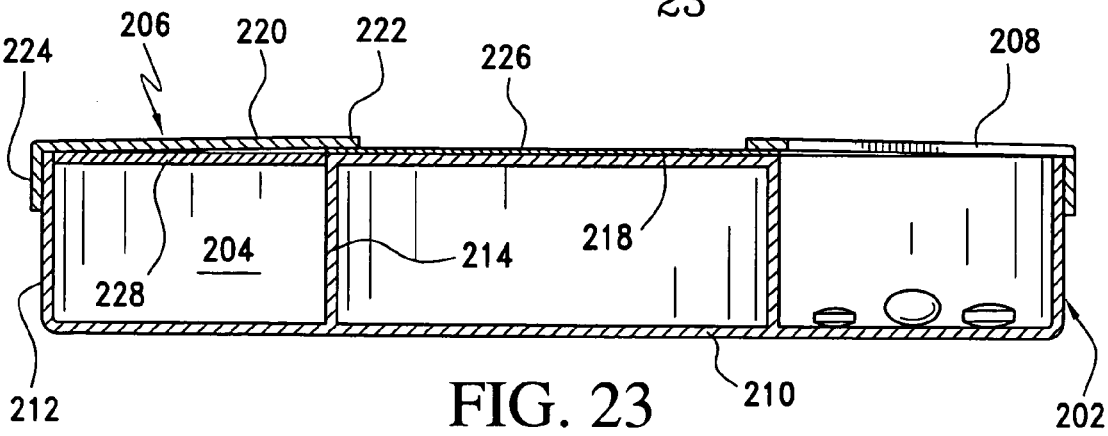
FIG. 23 is a cross-sectional view of the pill dispenser shown in FIG. 22 taken along the line 23—23 in FIG. 22.

Another embodiment of a pill dispenser in accordance with the present invention is shown in FIGS. 22 and 23 and is designated generally as 200. The pill dispenser 200 includes a base 202 defining a plurality of compartments 204 receivable of pills and a cover member 206 releasably engaging with the base 202 and rotatable relative to the base 202. The cover member 206 includes an opening 208 which is selectively aligned with each of the compartments 204 to enable the removal of any pills in that compartment 204. Opening 208 has a size substantially the same as or smaller than the cross-sectional size of a smallest one of the compartments 204 to avoid a situation where the opening 208 exposes more than one compartment 204.

The base 202 includes a substantially circular bottom wall 210, a cylindrical outer wall 212 extending from the peripheral edge of the bottom wall 210, a cylindrical inner wall 214 spaced from the outer wall 212 and a plurality of fins or dividers 216 extending between the outer wall 212 and the inner wall 214 for partitioning the space between the outer wall 212 and the inner wall 214 into the compartments 204. The fins 216 are spaced circumferentially around the base 202 and each extends in a radial direction. A circular wall 218 extends inward from an upper region of the inner wall 214. Other constructions for partitioning the space between the outer wall 212 and inner wall 214, instead of a plurality of fins 216, may be used in accordance with the invention.

Base 202 may be made of a rigid material such as a rigid plastic and may be formed as a unitary structure or from interconnected parts.

The cover member 206 has an annular planar portion 220 defining a central opening 222 and a rim 224 designed to overlie an upper edge of the outer wall 212 to frictionally engage the outer wall 212 and thereby provide a secure coupling between the cover member 206 and the base 202. The opening 208 is formed in the planar portion 222 proximate the rim 224. Cover member 206 may be formed from a transparent material, such as a transparent plastic, to enable viewing of the contents of the compartments 204 without removing the cover member 206 from engagement with the base 202.

A dosage guide 226 is held by the cover member 206 against the circular wall 218 of the base 202 and includes indicia for timed dosage of the pills from the compartments 204. The dosage guide 226 may be positioned adjacent the central opening 222 to enable viewing of the dosage guide 226.

The dosage guide 226 contains indicia relating to the dispensation of the pills in the compartments 204 which may include a number of the day (e.g., day one, day two, day three), the times of day, etc.

The dispenser 200 is provided with a shipping or storage condition in which all of the compartments 204 are closed and to this end, a covering wall 228 is formed opposite the bottom wall 210 over one of the compartments 204*a* to close that compartment 204*a* (see FIG. 23). The cover member 206 is positioned such that the opening 208 overlies the covering wall 228 when the dispenser 200 is shipped or whenever the dispenser 200 is stored and it is desired to have all of the compartments 204 closed.

The number of fins 216 in the dispenser 200 may be selected as desired to provide varying numbers of compartments 204. For example, for a pill dispenser 200 which will provide a dosage for two weeks, fourteen pill-dispensing compartments 204 might be preferred. Since an additional compartment 204*a* is sealed, fifteen compartments would be required and thus, the base 202 would be provided with fifteen fins 216.

In use, the cover member 206 is removed out of engagement with the base 202 and pills are placed in some or all of the compartments 204. The dosage guide 224 may be marked with the desired dosage times and days, if not pre-printed for specific dosage times, and aligned in the appropriate relationship to the pills in the compartments 204. The cover member 206 is placed onto the base 202 with the opening 218 over the covering wall 228.

For the first use, the cover member 206 is rotated relative to the base 202, i.e., by gripping the base 202 and rotating the cover member 206, so as to expose a first one of the compartments 204. The pills in the exposed compartment are removed, e.g., by tilting the dispenser 200 or turning the dispenser 200 over. At the next time for taking the pills, the base is again gripped and the cover member 206 rotated relative to the base 202 to expose another pill-containing compartment. This procedure continues until all of the compartments are empty at which time, the dispenser 200 may be re-filled by removing the cover member 206 from the base 202.

The pill dispenser 200 thus provides a easy and convenient way to dispense multiple dosages of medication. The pill dispenser 200 can be designed to be small and thus easily portable. It is also advantageous that the compartments 204 can hold multiple pills including different medications.

Figure 24:
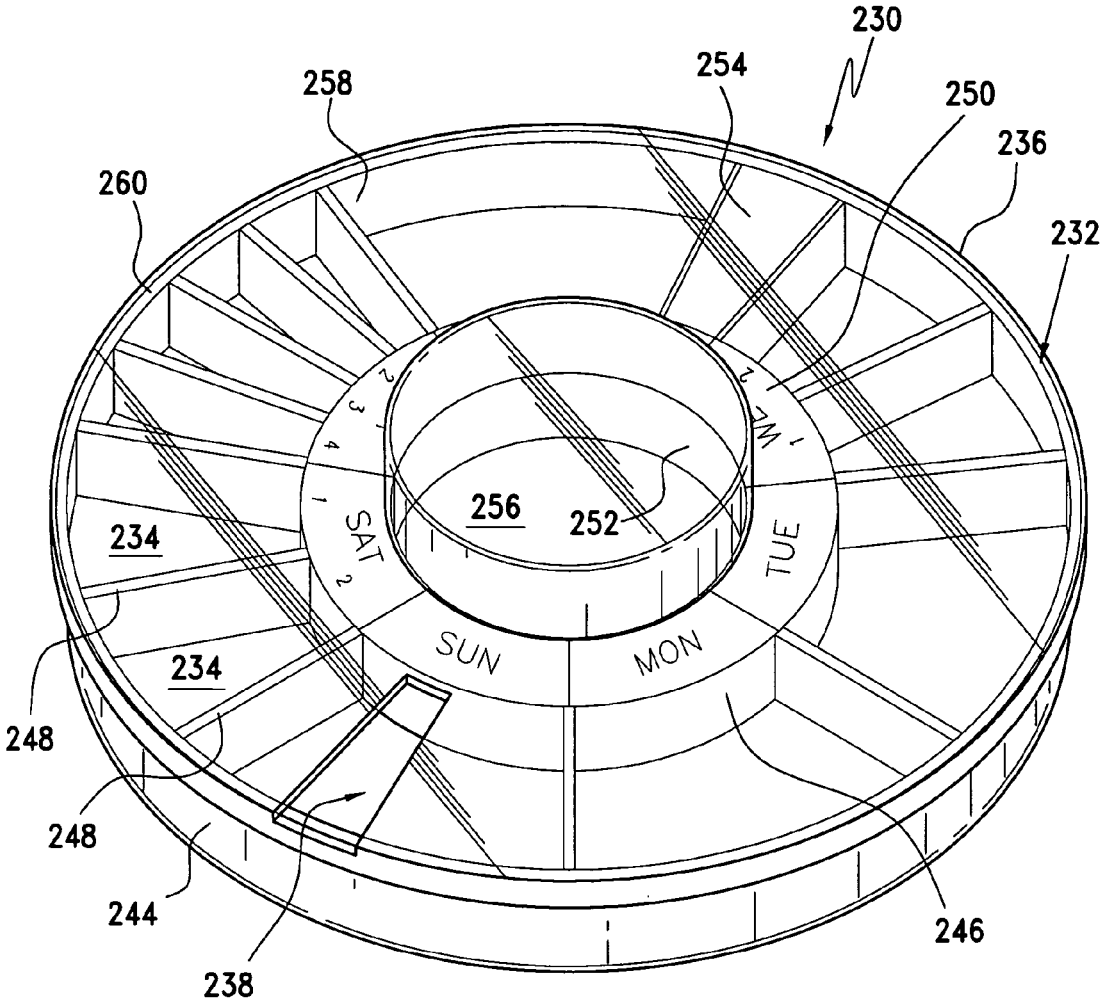
FIG. 24 is a top view of a fourth embodiment of a pill dispenser in accordance with the invention.
Figure 25:
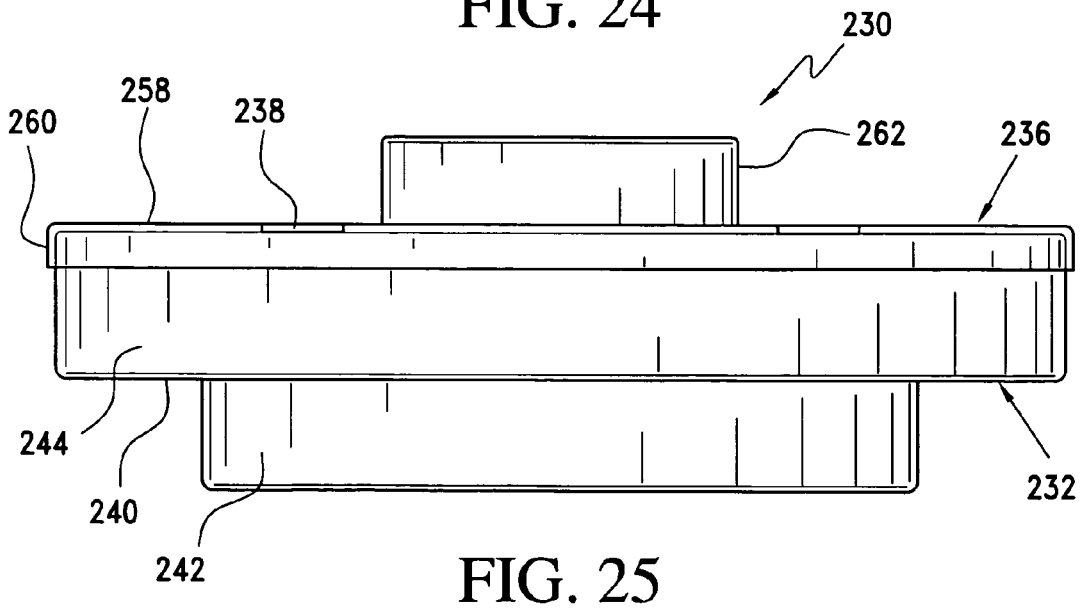
FIG. 25 is a side view of the pill dispenser shown in FIG. 24.
Figure 26:
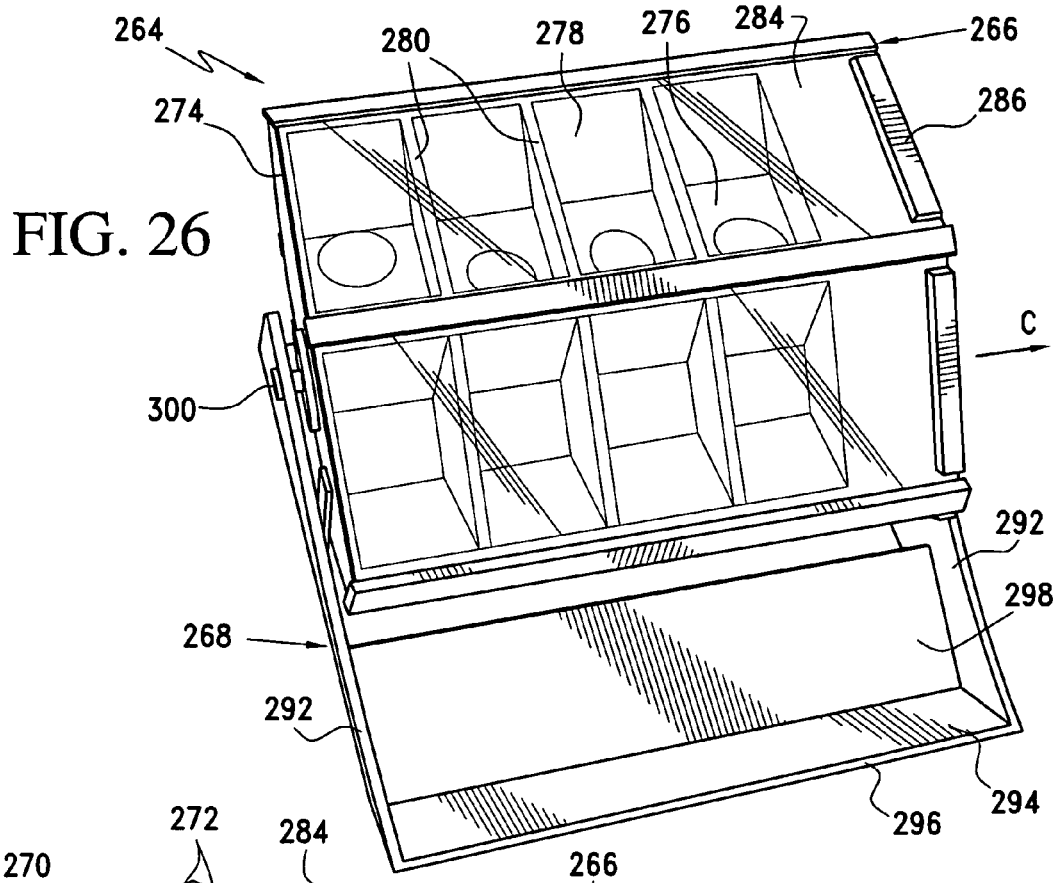
FIG. 26 is a front view of a fifth embodiment of a pill dispenser in accordance with the invention.

Another embodiment of a pill dispenser in accordance with the present invention is shown in FIGS. 24 and 25 and is designated generally as 230. The pill dispenser 230 includes a base 232 including a plurality of compartments 234 receivable of pills and a cover member 236 releasably engageable with the base 232 and rotatable relative thereto. The cover member 236 includes an opening 238 which is selectively aligned with each of the compartments 234 to enable the removal of any pills in that compartment 234. Opening 238 has a size substantially the same as or smaller than the cross-sectional size of a smallest one of the compartments 234 to avoid a situation where the opening 238 exposes more than one compartment 234.

Base 232 includes a substantially circular wall 240, a supporting wall 242 extending downward from a lower surface of the circular wall 240, an outer wall 244 extending from a peripheral edge of the circular wall 240, a cylindrical inner wall 246 spaced from the outer wall 244 and a plurality of fins or dividers 248 extending between the outer wall 244 and the inner wall 246 for partitioning the space between the outer wall 244 and the inner wall 246 into the compartments 234. The supporting wall 242 enables the dispenser 230 to rest on flat, horizontal surfaces. The outer wall 244 may be joined to the circular wall 240 by a curved section. Base 232 may be made of a rigid material such as a rigid plastic and may be formed as a unitary structure or interconnected parts.

The number of fins 248 may be selected as desired to provide varying numbers of compartments 234 around the circumference of the base 232. Further, the fins 248 may be variably spaced around the base 232 to provide compartments 234 having different sizes as shown. Other constructions for partitioning the space between the outer wall 244 and inner wall 246, instead of a plurality of fins 248, may be used in accordance with the invention.

An upper wall 250 is formed inward of the inner wall 246 and includes an annular portion defining a central opening 252 and a covering portion 254 situated opposite the circular wall 240 over one of the compartments 234 to close that compartment 234. This is necessary as the dispenser 230 may have a shipping or storage condition in which all of the compartments 234 are closed (inaccessible to prevent scattering of pills during shipment) so that the covering portion 254 will be aligned with the opening 238 when the dispenser 230 is shipped or whenever the dispenser 230 is stored and it is desired to have all of the compartments 234 closed.

The annular portion of the upper wall 250 may include indicia for the timed dosage of pills received in the compartments 234. The indicia may be marked on the annular portion for the upper wall 250 using a writing implement such as an erasable marker.

A compartment 256 is formed by the circular wall 240, the inner wall 246 and the upper wall 250. This compartment 256 could be used to store pills prior to placement in the compartments 234.

The cover member 236 is substantially circular and has an annular portion 258, a downwardly facing rim 260 at an outer peripheral edge of the annular portion 258 and a central elevated portion 262 in the middle of the annular portion 258. The rim 260 surrounds an upper part of the outer wall 244 (see FIG. 22). The opening 238 is formed in the annular portion 258 proximate the rim 260.

Cover member 236 may be formed from a transparent material, such as a transparent plastic, to enable viewing of the contents of the compartments 234 without removing the cover member 236 from engagement with the base 232.

In use, the cover member 236 is removed out of engagement with the base 232 and pills are placed in some or all of the compartments 234. The dosage indicia may be marked on the upper wall 250 in the appropriate relationship to the pills in the compartments 234. The cover member 236 is placed onto the base 232 with the opening 238 over the covering portion 254 of the upper wall 250.

For the first use, the cover member 236 is rotated relative to the base 232, i.e., by gripping the base 2332 and rotating the cover member 236, so as to expose a first one of the compartments 234. The pills in the exposed compartment 234 are removed, e.g., by tilting the dispenser 230 or turning the dispenser 230 over. The next time for taking the pills, the base 232 is again gripped and the cover member 236 rotated relative to the base 232 to expose another pill-containing compartment. This procedure continues until all of the compartments 234 are empty at which time, the dispenser 230 may be re-filled by removing the cover member 236 from the base 232 and removing pills from compartment 256 if used to store pills.

The pill dispenser 230 thus provides an easy and convenient way to dispense multiple dosages of medication. The pill dispenser 230 can be designed to be small and thus easily portable. It is also advantageous that the compartments 234 can hold multiple pills including different medications.

Referring now to FIGS. 26–31, another embodiment of a pill dispenser in accordance with the invention is designated generally as 264 and comprises a pill-storage housing 266 rotatably mounted on a base 268. Pill-storage housing 266 has a generally prismatic shape with each side of the prism defining a row 270 of pill-receiving compartments 272.

More specifically, pill-storage housing 266 has side walls 274, inner walls 276 extending in an axial direction (designated by arrow A) between the side walls 274 inward from the periphery of the side walls 274, axial walls 278 extending outward from the inner walls 276 around the circumference of the housing 266 and partition walls 280 extending between adjacent axial walls 278. As shown, each compartment 272 has an approximately trapezoidal cross-sectional shape in the radial direction with the top of the trapezoid being defined by an inner wall 276 and the sides being defined by axial walls 278. The partition walls 280 separate adjacent compartments 272 from one another (see FIG. 31).

Other arrangements of walls can be used to define the rows 270 of compartments 272. For example, the inner walls 276 might not be required if the axial walls 278 contact one another. In this manner, compartments with a triangular cross-sectional shape in the radial direction could be formed.

Figure 31:
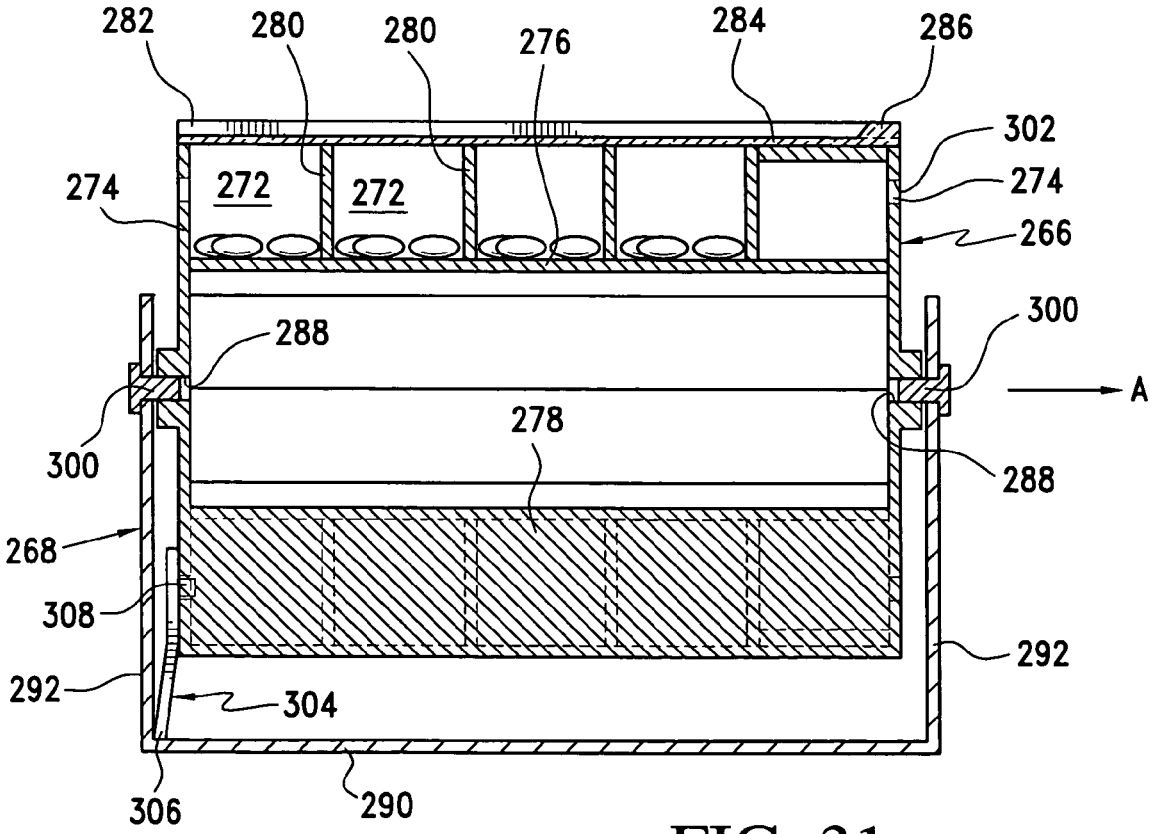
FIG. 31 is a cross-sectional view of the pill dispenser shown in FIG. 26 taken in an axial direction.

Each axial wall 278 includes shoulders 282 extending in the axial direction from an outward end of the axial wall 278 (see FIG. 31). Cover members 284 are provided to cover the compartments 272 and each slides over a respective one of the rows 270 of compartments 272. The cover members 284 are retained in position against the housing 266 by the shoulders 282 of the axial walls 278 (see FIG. 29). Each cover member 284 includes a lip 286 to enable easy manual handling for sliding the cover member 284 over the compartments 272 to selectively access the compartments 272.

Figure 27:
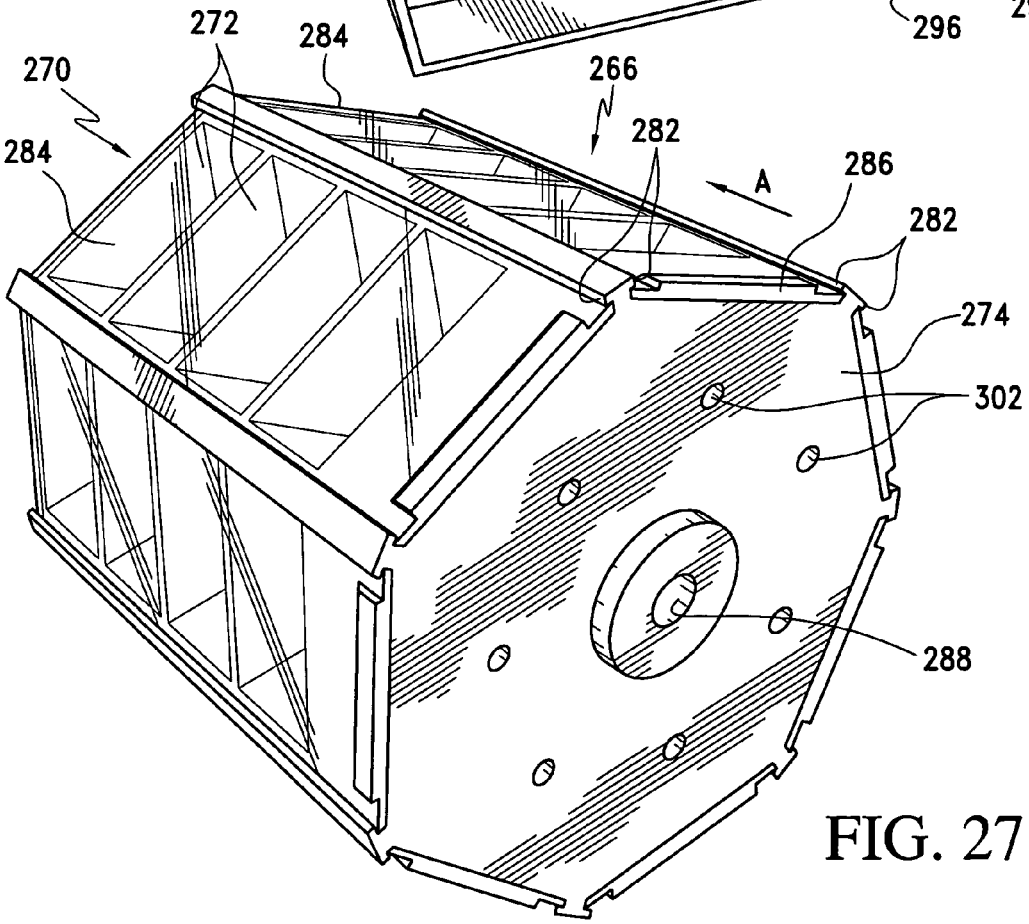
FIG. 27 is a perspective view of the pill-storage housing of the pill dispenser shown in FIG. 26.
Figure 28:
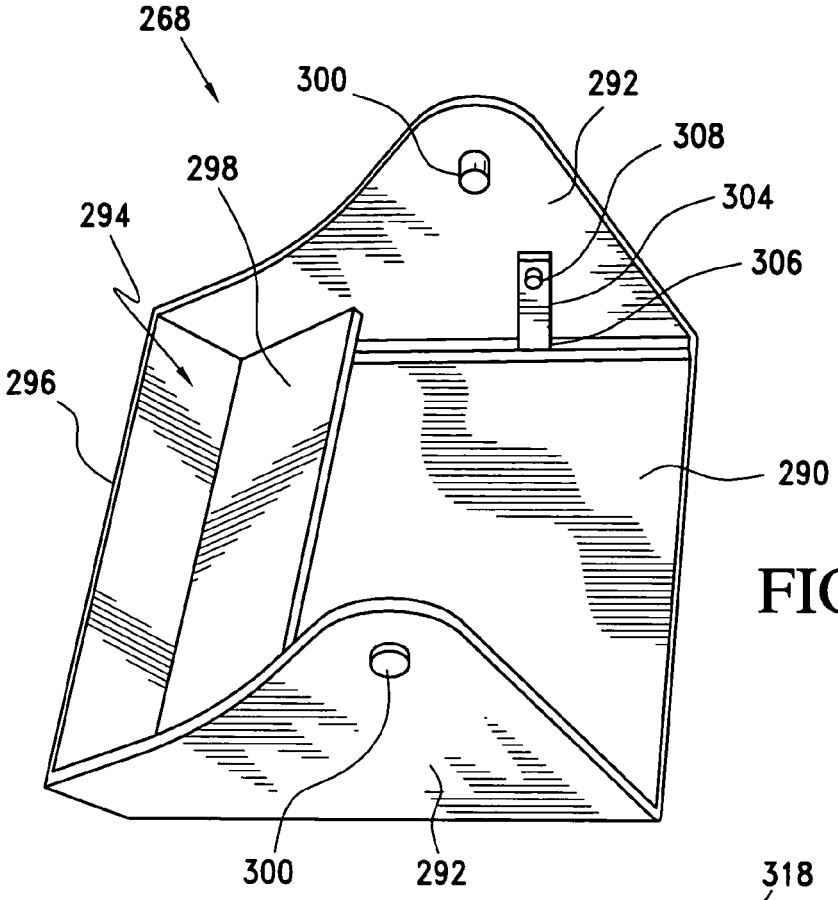
FIG. 28 is a side perspective view of the base of the pill dispenser shown in FIG. 26.
Figure 29:
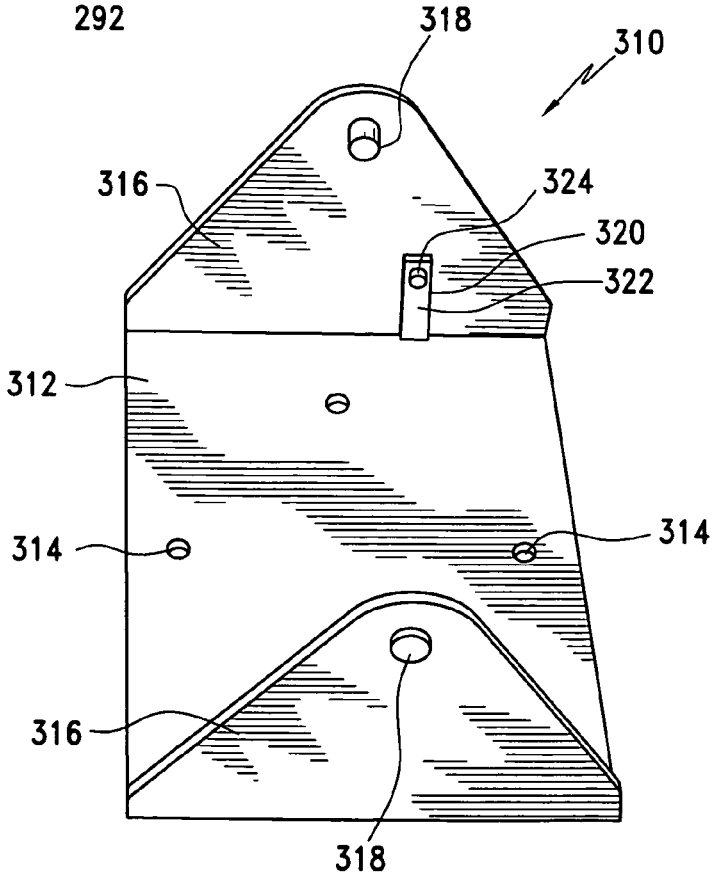
FIG. 29 is a side perspective view of a wall mounting bracket for use with the pill dispenser shown in FIG. 26.
Figure 30:
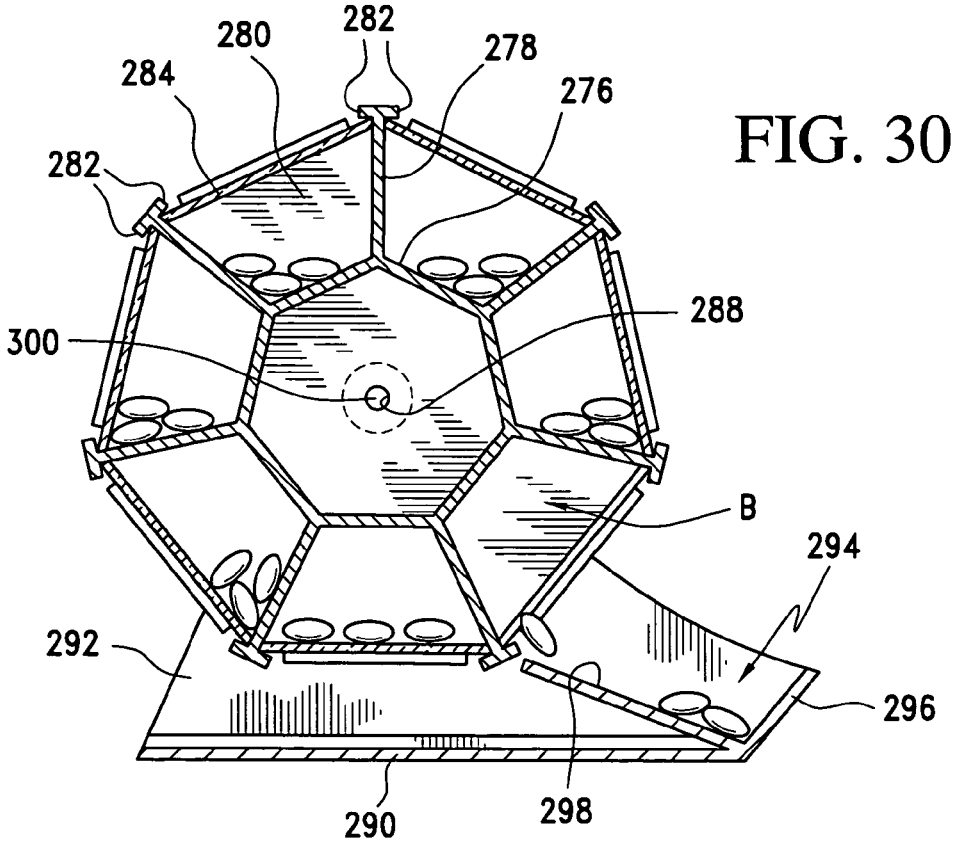
FIG. 30 is a cross-sectional view of the pill dispenser shown in FIG. 26 taken in a radial direction.

Each side wall 274 includes an aperture 288 encompassing a rotation axis of the housing 266 (see FIG. 27). The apertures 288 are designed to accommodate projections on the base 268 to enable rotation of the housing 266 relative to the base 268 (see FIG. 30).

The base 268 has a planar lower wall 290, opposed side walls 292 extending from opposite edges of the lower wall 290 and a pill-receiving tray 294 formed by a front wall 296 and an intermediate wall 298 extending between the side walls 292. Each side wall 292 includes an inwardly facing pin or projection 200 adapted to enter into an aperture 288 on a respective side wall 274 of the housing 266 (see FIG. 30). The base 268 is designed to be slightly flexible to enable removal of the housing 266 from engagement with the base 268, e.g., to be flexible to enable side walls 292 to be distanced from one another to allow removal and reinsertion of the housing 266 onto the projections 300 and thereby more easily facilitate insertion of pills into the compartments 272.

A detent mechanism is provided to fix the housing 266 in set positions relative to the base 268 such that each row 270 of compartments 272 is fixed in a set position relative to the tray 294. The detent mechanism includes apertures 302 formed in a side wall 274 of the housing 266 each in correspondence with a respective one of the rows 270 and a catch 304 arranged on the base 268. The catch 304 comprises an elongate member 306 projecting from the side wall 290 of the base 268 and having a projection 308 thereon adapted to extend into the apertures 302 in the side wall 274 of the housing 266 (see FIG. 28).

Member 306 is attached at only one end to the side wall 292 with the projection 308 being formed at an opposite end of the member 306 so that the end of the member 306 at which the projection 308 is mounted is flexible. The member 306 is thus capable of flexing inward upon rotation of the housing 266 when abutting against a solid portion of the side wall 274 and flexing outward when the projection 308 is able to enter into one of the apertures 302 in the side wall 274. The housing 266 is rotated in order to bring the rows 270 of compartments 272 alternatingly into a dispensing position.

The housing 266 includes seven rows 270 of pill-receiving compartments 272 which would be used advantageously for storing pills for a week, one row 270 corresponding to each day's medication. The four compartments 272 in each row 270 could be used for storing medication to be taken at four different times of the day, e.g., upon wake-up, four hours later, eight hours later and then twelve hours later.

Prior to use, a full week's worth of medication may be placed into the compartments 272 in the housing 266, with the pills for each day placed in a respective row 270 and the pills for each time period of each day placed in a respective compartment in the row 270 corresponding to that day. The pill dispenser 266 will thus be full of pills to be taken for a week.

Thereafter, the housing 266 is rotated, if necessary, until the catch 304 engages one of the apertures 302 in the side wall 274 of the housing 266 thereby bringing one of the rows 270 of compartments 272 into a pill-dispensing position (designated B in FIG. 28) in which the row 270 of compartments 272 is situated immediately above the pill-dispensing tray 294. When in this position, the cover member 284 over the row 270 of compartments 272 in the pill-dispensing position B is then slid outward (in the direction of arrow C in FIG. 24) to expose one of the compartments 272 with the result that as the cover member 284 slides to expose the compartment 272, any pills in the exposed compartment 272 fall into the tray 294. This procedure continues at later times, e.g., every four hours, to dispense the pill from the other compartments 272 in the row of compartments 270 in the pill-dispensing position B. That is, the cover member 284 is slid further outward in the direction of arrow C at the later times to expose another pill-containing compartment 272 causing the pills in that compartment 272 to fall into the pill-dispensing tray 294.

After the last compartment 272 in the row 270 of compartments 272 in the pill-dispensing position B is emptied, the cover member 284 is slid over the row 270 of now-empty compartments 272. Thereafter, the housing 266 is rotated to bring another row 270 of compartments 272 (containing pills yet to be dispensed) into the pill-dispensing position B, which is obtained when the catch 304 engages another aperture 302 in the side wall 274, and the cover member 284 over this new row 270 of compartments 272 is slid outward in stages to cause the removal of the pills from the compartments 272 in this row 270.

The base 268 is provided with the planar lower wall 290 to enable the pill dispenser 264 to rest on a flat surface. However, it is also envisioned that the housing 266 can be mounted to a wall or other vertical surface.

In this case, the base 268 is replaced by a wall mounting bracket 310 which includes a planar wall 312 having apertures 314 and side walls 316 arranged at opposite edges of the planar wall 312 (see FIG. 27). The side walls 316 each include an inwardly facing pin or projection 318 which is adapted to enter into the aperture 288 on a respective side wall 274 of the housing 266.

Bracket 310 may be attached to a wall or other vertical surface by inserting screws, nails and the like through the apertures 314 in the planar wall 312 and into the vertical surface. Other attachment mechanisms may also be used to attach the bracket 310 to the vertical surface including for example, hook and loop-type fasteners or adhesives.

A detent mechanism is provided to fix the housing 266 in set positions relative to the base 268 such that each row 270 of compartments 272 is fixed in a set position relative to the bracket 310. The detent mechanism includes the apertures 302 formed in the side wall 274 of the housing 266, as discussed above, and a catch 320 arranged on the bracket 310. The catch 320 comprises an elongate member 322 projecting from the side wall 316 of the bracket 310 and having a projection 324 thereon adapted to extend into the apertures 302 in the side walls 274 of the housing 266.

Member 322 is attached at only one end to the side wall 316 with the projection 324 being formed at an opposite end of the member 322 so that the end of the member 322 at which the projection 324 is mounted is flexible. The member 322 is thus capable of flexing inward upon rotation of the housing 266 when abutting against a solid portion of the side wall 274 and flexing outward when the projection 324 is able to enter into one of the apertures 302 in the side wall 274. The housing 266 is rotated in order to bring the rows 270 of compartments 272 alternatingly into a dispensing position.

When the housing 266 is mounted using bracket 310, a pill-dispensing tray is not provided below the row 270 of compartments 272 when in the pill-dispensing position. Rather, it is necessary to manually catch the pill(s) as they fall from the compartments 272 when the cover member 284 is slid to expose each compartment 272. Otherwise, the manner of use of the dispenser using the bracket 310 is the same as for the dispenser using the base 268.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

I claim:

1. A pill dispenser, comprising:

a base including a plurality of compartments receivable of pills;

a cover member releasably engaging with said base and rotatable relative to said base when in engagement with said base, said cover member including an access opening selectively alignable with each of said compartments upon rotation of said cover member relative to said base to enable removal of pills in each of said compartments when in alignment with said access opening;

a retaining member removably arranged in connection with said base; and a pill holder removably received in said retaining member.

2. The pill dispenser of claim 1, wherein said cover member and said retaining member include cooperating coupling means for removably coupling said cover member and said retaining member together.

3. The pill dispenser of claim 2, wherein said coupling means comprise at least one aperture formed in a circular rim extending upward from an inner edge of an annular portion of said cover member around a circular opening, an axially extending channel formed on an inner surface of said rim proximate each of said at least one aperture, at least one flexible tab formed on said retaining member and arranged to pass into a respective one of said at least one aperture on said rim of said cover member and an elongate projection formed on said retaining member and arranged to pass into a respective one of said channels on said rim of said cover member.

4. The pill dispenser of claim 1, wherein said pill holder includes an electronic housing containing electronic clock and timer components and a pill-receiving housing removably coupled to said electronic housing.

5. The pill dispenser of claim 4, wherein said pill holder includes a removable plunger arranged in said pill-receiving housing to prevent pills from rattling around in said pill-receiving housing.

6. The pill dispenser of claim 1, wherein said retaining member and said pill holder include cooperating coupling means for releasably coupling said pill holder to said retaining member.

7. The pill dispenser of claim 1, wherein said pill holder includes a clock/alarm/timer unit arranged to allow a user to set and view the current time, and to set a time or times to take medication and cause an alarm to be activated at the set time or set times and remain activated for up to 25 hours if pills are not removed from one of said compartments.

8. The pill dispenser of claim 1, wherein said cover member and said base include cooperating engagement means for releasably engaging said cover member to said base.

9. The pill dispenser of claim 8, wherein said engagement means comprise a flange projecting inward from an edge of a circular rim extending downward from an outer peripheral edge of said cover member and a lip extending outward from an upper peripheral edge of said base, said lip including a recess having substantially the same size as said flange.

10. The pill dispenser of claim 1, wherein said base includes an annular lower wall, an outer wall extending upward from an outer edge of said lower wall, a first substantially cylindrical inner wall spaced from said outer wall and a plurality of dividers extending between said outer wall and said first inner wall for partitioning a space defined by said lower wall, said outer wall and said first inner wall into said compartments.

11. The pill dispenser of claim 10, wherein said base further comprises an upper wall contiguous with and extending inward from said first inner wall, said upper wall including indicia for the timed dosage of pills received in said compartments arranged in alignment with said compartments.

12. The pill dispenser of claim 11, wherein said base further comprises a second, substantially cylindrical inner wall contiguous with and extending downward from said upper wall and an inner base wall contiguous with and extending inward from said second inner wall to thereby form a cavity in said base between said second inner wall and said inner base wall.

13. The pill dispenser of claim 12, and means for partitioning the space between said outer wall and said inner wall into said compartments.

14. The pill dispenser of claim 13, wherein said engagement means comprises a projection formed on said inner base wall of said base and having an opening in an upper surface with a distinct pattern of indentations and a projection extending downward from a bottom wall of said retaining member and having a pattern of flanges corresponding to the pattern of indentations formed on said projection of said base.

15. The pill dispenser of claim 1, wherein said base includes a push member having an upper position in which it extends through said access opening to prevent rotation of said cover member about said base and a lower position in which rotation of said cover member relative to said base is permitted.

16. The pill dispenser of claim 1, wherein said base includes a substantially circular bottom wall, a cylindrical outer wall extending from a peripheral edge of said bottom wall, a cylindrical inner wall spaced from said outer wall.

17. The pill dispenser of claim 16, wherein said base includes a covering wall formed opposite said bottom wall over one of said compartments.

18. The pill dispenser of claim 16, wherein said means for partitioning the space between said outer and inner walls comprise fins spaced circumferentially around said base and each extending between said outer wall and said inner wall.

19. The pill dispenser of claim 16, wherein said base includes a circular upper wall extending from an upper peripheral edge of said inner wall, further comprising dosage indicia arranged on said circular upper wall.

20. The pill dispenser of claim 1, wherein said base includes a support wall, an outer wall extending from a peripheral edge of said support circular wall, an inner wall spaced from said outer wall and means for partitioning a space between said outer wall and said inner wall into said compartments. wherein said retaining member and said base include engagement means for removably engaging said retaining member to said base.

21. The pill dispenser of claim 20, wherein said means for partitioning the space between said outer wall and said inner wall comprise fins spaced circumferentially around said base and each extending between said outer wall and said inner wall.

22. The pill dispenser of claim 21, wherein said fins are variably spaced around the circumference of said base to provide compartments having different sizes.

23. The pill dispenser of claim 20, wherein said base further includes a supporting section extending downward from a lower surface of said support wall.

24. The pill dispenser of claim 20, wherein said base further comprises an upper wall formed inward of said inner wall and including an annular portion defining a central opening and a covering portion situated opposite said support wall over one of said compartments to close said one of said compartments.

25. The pill dispenser of claim 24, wherein said upper wall includes dosage indicia for the timed dosage of pills received in said compartments.

26. A pill dispenser, comprising:

a base including a plurality of compartments receivable of pills; and a cover member releasably engaging with said base and rotatable relative to said base when in engagement with said base, said cover member including an access opening selectively alignable with each of said compartments upon rotation of said cover member relative to said base to enable removal of pills in each of said compartments when in alignment with said access opening, said cover member and said base including cooperating engagement means for releasably engaging said cover member to said base, said engagement means comprising a flange projecting inward from an edge of a circular rim extending downward from an outer peripheral edge of said cover member and a lip extending outward from an upper peripheral edge of said base, said lip including a recess having substantially the same size as said flange.

27. A pill dispenser, comprising:

a base including an annular lower wall, an outer wall extending upward from an outer edge of said lower wall, a first substantially cylindrical inner wall spaced from said outer wall and a plurality of dividers extending between said outer wall and said first inner wall for partitioning a space defined by said lower wall, said outer wall and said inner wall into a plurality of compartments receivable of pills, said base further including an upper wall contiguous with and extending inward from said first inner wall, said upper wall including indicia for the timed dosage of pills received in said compartments arranged in alignment with said compartments; and a cover member releasably engaging with said base and rotatable relative to said base when in engagement with said base, said cover member including an access opening selectively alignable with each of said compartments upon rotation of said cover member relative to said base to enable removal of pills in each of said compartments when in alignment with said access opening.

28. A pill dispenser, comprising:

a base including a plurality of compartments receivable of pills; and a cover member releasably engaging with said base and rotatable relative to said base when in engagement with said base, said cover member including an access opening selectively alignable with each of said compartments upon rotation of said cover member relative to said base to enable removal of pills in each of said compartments when in alignment with said access opening, said base including a push member having an upper position in which it extends through said access opening to prevent rotation of said cover member about said base and a lower position in which rotation of said cover member relative to said base is permitted.

29. A pill dispenser, comprising:

a base including a substantially circular bottom wall, a cylindrical outer wall extending from a peripheral edge of said bottom wall, a cylindrical inner wall spaced from said outer wall and means for partitioning the space between said outer wall and said inner wall into a plurality of compartments receivable of pills, said base further including a circular upper wall extending from an upper peripheral edge of said inner wall;

a cover member releasably engaging with said base and rotatable relative to said base when in engagement with said base, said cover member including an access opening selectively alignable with each of said compartments upon rotation of said cover member relative to said base to enable removal of pills in each of said compartments when in alignment with said access opening; and dosage indicia arranged on said circular upper wall of said base.

* * * * *